US011186792B2

(12) United States Patent
Petts et al.

(10) Patent No.: US 11,186,792 B2
(45) **Date of Patent: *Nov. 30, 2021**

(54) COMPOSITION AND METHODS AND USES RELATING THERETO

(71) Applicant: Innospec Limited, Ellesmere Port (GB)

(72) Inventors: Matthew Petts, Elton Chester (GB); Katherine Le Manquais, Ellesmere Port (GB); Alan Norman Ross, Wigan (GB)

(73) Assignee: Innospec Limited, Ellesmere Port (GB)

( * ) Notice: Subject to any disclaimer, the term of this patent is extended or adjusted under 35 U.S.C. 154(b) by 32 days.

This patent is subject to a terminal disclaimer.

(21) Appl. No.: 16/496,263

(22) PCT Filed: Mar. 28, 2018

(86) PCT No.: PCT/GB2018/050836

§ 371 (c)(1),
(2) Date: Sep. 20, 2019

(87) PCT Pub. No.: WO2018/178683

PCT Pub. Date: Oct. 4, 2018

(65) Prior Publication Data

US 2020/0024533 A1 Jan. 23, 2020

(30) Foreign Application Priority Data

Mar. 30, 2017 (GB) ..... 1705095

(51) Int. Cl.
*C10L 1/222* (2006.01)
*C10L 10/04* (2006.01)
*C10L 10/02* (2006.01)

(52) U.S. Cl.
CPC ..... *C10L 1/2222* (2013.01); *C10L 10/02* (2013.01); *C10L 10/04* (2013.01); *C10L 2200/0446* (2013.01); *C10L 2230/22* (2013.01); *C10L 2270/026* (2013.01)

(58) Field of Classification Search
CPC ..... C10L 10/02; C10L 10/04; C10L 1/1905; C10L 1/2222; C10L 1/2235; C10L 2200/0446; C10L 2230/22; C10L 2270/026; C10M 133/06; C10M 133/08; C10M 2207/288; C10M 2215/02; C10M 2215/042; C10N 2030/04
See application file for complete search history.

(56) References Cited

U.S. PATENT DOCUMENTS

| | | | |
|---|---|---|---|
| 5,925,151 | A | 7/1999 | DeCanio et al. |
| 2008/0052985 | A1 | 3/2008 | Stevenson et al. |
| 2008/0060259 | A1 | 3/2008 | Breakspear et al. |
| 2008/0060608 | A1 | 3/2008 | Breakspear et al. |
| 2008/0113890 | A1 | 5/2008 | Moreton et al. |
| 2008/0307698 | A1 | 12/2008 | Barton et al. |
| 2009/0282731 | A1 | 11/2009 | Malfer et al. |
| 2011/0143981 | A1 | 6/2011 | Barton et al. |
| 2011/0258917 | A1 | 10/2011 | Garcia Castro et al. |
| 2011/0315107 | A1 | 12/2011 | Grabarse et al. |
| 2012/0010112 | A1 | 1/2012 | Grabarse et al. |
| 2013/0031827 | A1 | 2/2013 | Reid et al. |
| 2013/0224653 | A1 | 8/2013 | Itatani |
| 2014/0238328 | A1* | 8/2014 | Fang ..... C10L 1/2222 123/1 A |
| 2015/0159103 | A1 | 6/2015 | Roeger-Goepfert et al. |
| 2017/0121621 | A1* | 5/2017 | Fabre ..... C10L 1/22 |
| 2017/0247624 | A1 | 8/2017 | Papin et al. |

FOREIGN PATENT DOCUMENTS

| | | | |
|---|---|---|---|
| CN | 102382504 | A | 3/2012 |
| EP | 0565285 | A1 | 10/1993 |
| EP | 1254889 | A1 | 11/2002 |

(Continued)

OTHER PUBLICATIONS

International Search Report and Written Opinion issued in PCT/GB2018/050836 dated May 30, 2018.
Combined Search and Examination Report issued in Application No. GB1805059.1 dated Nov. 19, 2018.
Search Report issued in Application No. GB1705095.6, dated Jan. 23, 2018.

(Continued)

*Primary Examiner* — Ellen M McAvoy
*Assistant Examiner* — Chantel L Graham
(74) *Attorney, Agent, or Firm* — Burns & Levinson LLP; Janine M. Susan

(57) ABSTRACT

A quaternary ammonium salt of formula (I): (I) where in X is a linking group; Y is O, NH or $NR^1$ wherein $R^1$ is H or an optionally substituted hydrocarbyl group; $Q^+$ is a moiety that includes a quaternary ammonium cation; $A^-$ is an anion; $R^2$ is an optionally substituted alkylene group; $R^3$ is hydrogen or an optionally substituted hydrocarbyl group; and n is 0 or a positive integer; provided that n is not 0 when $R^3$ is hydrogen.

(I)

23 Claims, 3 Drawing Sheets

(56) References Cited

FOREIGN PATENT DOCUMENTS

| | | | |
|---|---|---|---|
| EP | 1884556 | A2 | 2/2008 |
| EP | 1900795 | A1 | 3/2008 |
| JP | 200017118 | A | 1/2000 |
| WO | 2006135881 | A2 | 12/2006 |
| WO | 2009040583 | A1 | 4/2009 |
| WO | 2010132259 | A1 | 11/2010 |
| WO | 2011095819 | A1 | 8/2011 |
| WO | 2013017889 | A1 | 2/2013 |
| WO | 2014066344 | A1 | 5/2014 |
| WO | 2015011505 | A1 | 1/2015 |
| WO | 2015011506 | A1 | 1/2015 |
| WO | 2015011507 | A1 | 1/2015 |
| WO | 2015184276 | A1 | 12/2015 |
| WO | 2016016641 | A1 | 2/2016 |
| WO | 2017017454 | A1 | 2/2017 |

OTHER PUBLICATIONS

Mndzhoyan et al., "Derivatives of Dibasic Carboxylic Acids. XIII. Dialkylaminoethylamides of Monoalkyl Esters of Succinic Acid" Doklady Akademii Nauk Armyanskoi SSR, 22 (No. 1), 23-8, 1956.

* cited by examiner

| | |
|---|---|
| Design: | Four cylinders in line, overhead camshaft, variable geometry turbocharger with EGR |
| Capacity: | 1997 $cm^3$ |
| Combustion chamber: | Four valves, bowl in piston, direct injection |
| Power: | 120 kW @ 3750 rpm |
| Torque: | 340 Nm @ 2000 rpm |
| Injection system: | Common rail with solenoid type injectors<br>Delphi Injection System |
| Emissions control: | Conforms to Euro V limit values when combined with exhaust gas post-treatment system. |

FIG. 1

| Step | Speed (rpm) | Torque (N.m) | Duration (s) |
|---|---|---|---|
| 1 | 3750 | 280 | 1470 |
| 1 - Ramp →2 | - | - | 30 |
| 2 | 1000 | 10 | 270 |
| 2 - Ramp →1 | - | - | 30 |

The ramp times of 30 seconds are included in the duration of each step.

FIG. 2

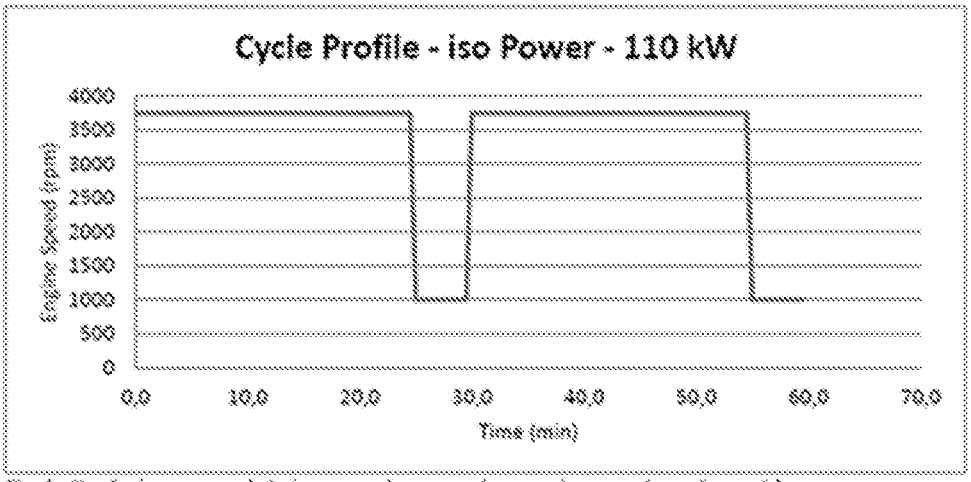

Each Cycle is repeated 6 times so the complete main run phase lasts 6 hours.

FIG. 3

| Cold start | | | | | | | | | |
|---|---|---|---|---|---|---|---|---|---|
| | | Starting | | | | Exhaust temperature consistency | | | |
| Cold Start | Start Y/N | Maximum Merits | Number of Attempts (1 = first start) | Deduction | Merits | Maximum Merits | Exhaust Temperature Max Cyl. Deviation (°C) | Deduction | Merits |
| #0 | not rated | | | | | | | | |
| #1 | Y | 5 | 1 | 0 | 5 | 5 | 21.8 | 0 | 5 |
| #2 | Y | 5 | 1 | 0 | 5 | 5 | 18.1 | 0 | 5 |
| #3 | Y | 5 | 1 | 0 | 5 | 5 | 15.5 | 0 | 5 |
| #4 | Y | 5 | 1 | 0 | 5 | 5 | 20.2 | 0 | 5 |
| #5 | Y | 5 | 1 | 0 | 5 | 5 | 22.6 | 0 | 5 |
| Total merits | | | | | 25 | | | | 25 |

| Main run | | | | | | | | | | |
|---|---|---|---|---|---|---|---|---|---|---|
| Operability | | | | | | | | | | |
| Main run | Maximum Merits | Number of ECU Fault resets | Deduct -ion | Stall (Y/N) | Deduct -ion | Max Pedal Position at 1000 rpm / 10 N.m (%) | Deduct -ion | Max Inject. Balancing Coeff. (rpm) | Deduct -ion | Merits |
| #1 | 5 | 0 | 0 | N | 0 | 15.4 | 0 | 15 | 0 | 5 |
| #2 | 5 | 0 | 0 | N | 0 | 13.5 | 0 | 15 | 0 | 5 |
| #3 | 5 | 0 | 0 | N | 0 | 13.6 | 0 | 16 | 0 | 5 |
| #4 | 5 | 0 | 0 | N | 0 | 13.8 | 0 | 15 | 0 | 5 |
| #5 | 5 | 0 | 0 | N | 0 | 14.5 | 0 | 15 | 0 | 5 |
| | | | | | | | | | | 25 |

| | |
|---|---|
| | |
| Global Rating - Summary (Merit / 10) | 10 |

FIG. 5

COMPOSITION AND METHODS AND USES RELATING THERETO

CROSS-REFERENCE TO RELATED APPLICATIONS

This application is a U.S. national stage application under 35 U.S.C. 371 of co-pending International Application No. PCT/G2018/050836, filed on Mar. 28, 2018, and entitled COMPOSITION AND METHODS AND USES RELATING THERETO, which in turn claims priority to and benefit of Great Britain Patent Application Nos. 1705095.6, filed Mar. 30, 2017, which is incorporated by reference herein in its entirety for all purposes.

BACKGROUND

The present invention relates to novel quaternary ammonium compounds, compositions comprising the same and methods and uses relating thereto. In particular the invention relates to methods and uses for improving the performance of engines using fuel additives, especially diesel engines. In particular the invention relates to additives for diesel fuel compositions for use in diesel engines with high pressure fuel systems.

Due to consumer demand and legislation, diesel engines have in recent years become much more energy efficient, show improved performance and have reduced emissions.

These improvements in performance and emissions have been brought about by improvements in the combustion process. To achieve the fuel atomisation necessary for this improved combustion, fuel injection equipment has been developed which uses higher injection pressures and reduced fuel injector nozzle hole diameters. The fuel pressure at the injection nozzle is now commonly in excess of 1500 bar ($1.5\times10^8$ Pa). To achieve these pressures the work that must be done on the fuel also increases the temperature of the fuel. These high pressures and temperatures can cause degradation of the fuel. Furthermore, the timing, quantity and control of fuel injection has become increasingly precise. This precise fuel metering must be maintained to achieve optimal performance.

Diesel engines having high pressure fuel systems can include but are not limited to heavy duty diesel engines and smaller passenger car type diesel engines. Heavy duty diesel engines can include very powerful engines such as the MTU series 4000 diesel having 20 cylinder variants designed primarily for ships and power generation with power output up to 4300 kW or engines such as the Renault dXi 7 having 6 cylinders and a power output around 240 kW. A typical passenger car diesel engine is the Peugeot DW10 having 4 cylinders and power output of 100 kW or less depending on the variant.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues, lacquers or sticky or gum-like residues. Diesel fuels become more and more unstable the more they are heated, particularly if heated under pressure. Thus diesel engines having high pressure fuel systems may cause increased fuel degradation. In recent years the need to reduce emissions has led to the continual redesign of injection systems to help meet lower targets. This has led to increasingly complex injectors and lower tolerance to deposits.

The problem of injector fouling may occur when using any type of diesel fuels. However, some fuels may be particularly prone to cause fouling or fouling may occur more quickly when these fuels are used. For example, fuels containing biodiesel and those containing metallic species may lead to increased deposits.

When injectors become blocked or partially blocked, the delivery of fuel is less efficient and there is poor mixing of the fuel with the air. Over time this leads to a loss in power of the engine and increased exhaust emissions and poor fuel economy.

Deposits are known to occur in the spray channels of the injector, leading to reduced flow and power loss. As the size of the injector nozzle hole is reduced, the relative impact of deposit build up becomes more significant. Deposits are also known to occur at the injector tip. Here they affect the fuel spray pattern and cause less effective combustion and associated higher emissions and increased fuel consumption.

In addition to these "external" injector deposits in the nozzle hole and at the injector tip which lead to reduced flow and power loss, deposits may occur within the injector body causing further problems. These deposits may be referred to as internal diesel injector deposits (or IDIDs). IDIDs occur further up inside the injector on the critical moving parts. They can hinder the movement of these parts affecting the timing and quantity of fuel injection. Since modern diesel engines operate under very precise conditions these deposits can have a significant impact on performance.

IDIDs cause a number of problems, including power loss and reduced fuel economy due to less than optimal fuel metering and combustion. Initially the engine may experience cold start problems and/or rough engine running. These deposits can lead to more serious injector sticking. This occurs when the deposits stop parts of the injector from moving and thus the injector stops working. When several or all of the injectors stick the engine may fail completely.

IDIDs are recognised as a serious problem by those working in the field and a new engine test has been developed by the industry based organisation, the Coordinating European Council (CEC). The IDID DW10C test was developed to be able to discriminate between a fuel that produces no measurable deposits and one which produces deposits that cause startability issues considered unacceptable. The objective of the test is to discriminate between fuels that differ in their ability to produce IDIDs in direct injection common rail diesel engines.

The present inventors have studied internal diesel injector deposits and have found that they contain a number of components. As well as carbonaceous deposits the presence of lacquers and/or carboxylate residues can lead to injector sticking.

Lacquers are varnish-like deposits which are insoluble in fuel and common organic solvents. Some occurrences of lacquers have been found by analysis to contain amide functionality and it has been suggested that they form due to the presence of low molecular weight amide containing species in the fuel.

Carboxylate residues may be present from a number of sources. By carboxylate residues we mean to refer to salts of carboxylic acids. These may be short chain carboxylic acids but more commonly long chain fatty acid residues are present. The carboxylic residues may be present as ammonium and/or metal salts. Both carboxylic acids and metals may be present in diesel fuel from a number of sources.

Carboxylic acids may occur due to oxidation of the fuel, may form during the combustion process and are commonly added into fuel as lubricity additives and/or corrosion inhibitors. Residual fatty acids may be present in the fatty acid methyl esters included as biodiesel and they may also be present as byproducts in other additives. Derivatives of fatty acids may also be present and these may react or decompose to form carboxylic acids.

Various metals may be present in fuel compositions. This may be due to contamination of the fuel during manufacture, storage, transport or use or due to contamination of fuel additives. Metal species may also be added to fuels deliberately. For example, transition metals are sometimes added as fuel borne catalysts to improve the performance of diesel particulate filters.

The present inventors believe that one of the many causes of injector sticking occurs when metal or ammonium species react with carboxylic acid species in the fuel. One example of injector sticking has arisen due to sodium contamination of the fuel. Sodium contamination may occur for a number of reasons. For example, sodium hydroxide may be used in a washing step in the hydrodesulfurisation process and could lead to contamination. Sodium may also be present due to the use of sodium-containing corrosion inhibitors in pipelines. Another example can arise from the presence of calcium from, for example, interaction with or contamination with a lubricant or from calcium chloride used in salt drying processes in refineries. Other metal contamination may occur for example during transportation due to water bottoms.

Metal contamination of diesel fuel and the resultant formation of carboxylate salts is believed to be a significant cause of injector sticking. The formation of lacquers is yet another major cause of injector sticking.

One approach to combatting IDIDs and injector sticking resulting from carboxylate salts is to try to eliminate the source of metal contamination and/or carboxylic acids or to try to ensure that particularly problematic carboxylic acids are eliminated. This has not been entirely successful and there is a need for additives to provide control of IDIDs.

Deposit control additives are often included in fuel to combat deposits in the injector nozzle or at the injector tip. These may be referred to herein as "external injector deposits". Additives are also used to control deposits on vehicle fuel filters. However additives which have been found to be useful to control "external deposits" and fuel filter deposits are not always effective at controlling IDIDs. A challenge for the additive formulator is to provide more effective detergents.

It is an aim of the present invention to provide methods and uses which improve the performance of a diesel engine, especially a diesel engine having a high pressure fuel system. This may be achieved for example by preventing or reducing the formation of IDIDs and/or by reducing or removing existing IDIDs. The invention provides methods and uses which control "external injector deposits" and/or fuel filter deposits.

Reducing or preventing the formation of deposits may be regarded as providing "keep clean" performance. Reducing or removing existing deposits may be regarded as providing "clean up" performance. It is an aim of the present invention to provide "keep clean" and/or "clean up" performance.

Many different types of compounds are known in the art for use as detergent additives in fuel oil compositions, for the control of deposits in engines.

BRIEF SUMMARY

The present inventors have developed novel quaternary ammonium compounds that can be useful as additives in fuel and lubricant compositions.

BRIEF DESCRIPTION OF THE DRAWINGS

FIG. 1 illustrates engine characteristics of a PSA DW10C engine;

FIG. 2 illustrates the main running cycle characteristics for test fuel RF06;

FIG. 3 illustrates ramp times of the steps of FIG. 2;

FIG. 5 illustrates an example of a Merit Rating Chart for the test fuel.

DETAILED DESCRIPTION

Figure 4:
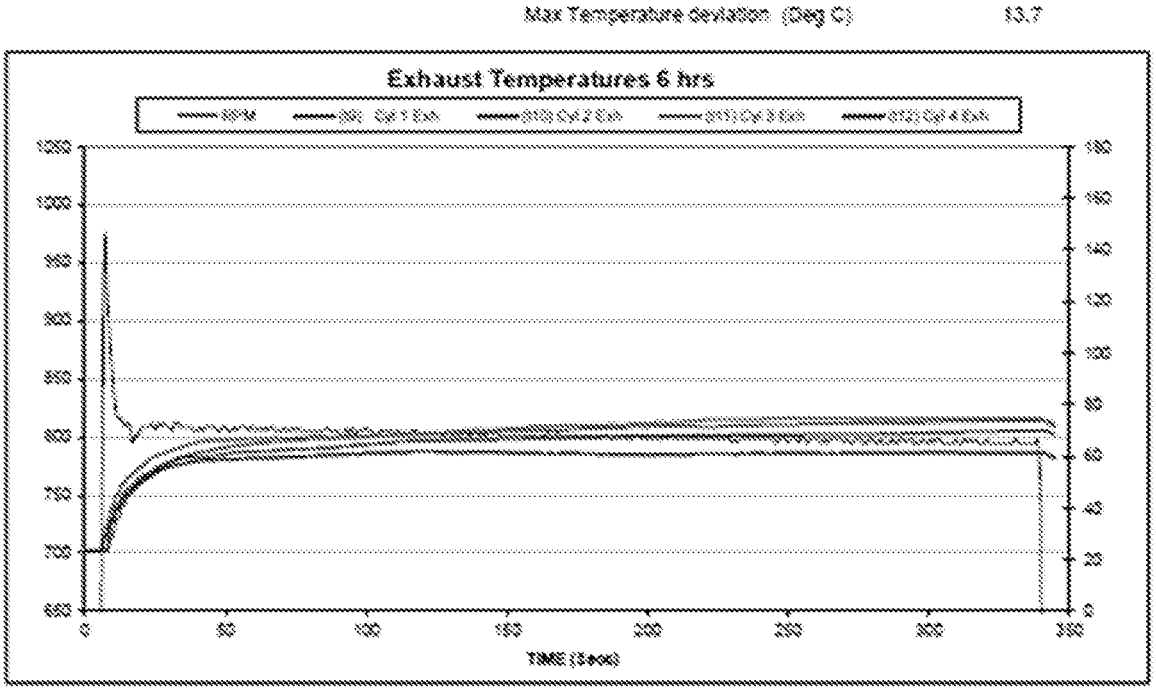
FIG. 4 illustrates examples of exhaust temperatures of the test fuel within <30° C. deviation.

According to a first aspect of the present invention there is provided a quaternary ammonium salt of formula (I):

(I)

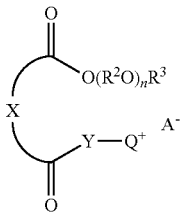

wherein X is a linking group, Y is O, NH or $NR^1$ wherein $R^1$ is H or an optionally substituted hydrocarbyl group; $Q^+$ is a moiety that includes a quaternary ammonium cation; $A^-$ is an anion; $R^2$ is an optionally substituted alkylene group; $R^3$ is hydrogen or an optionally substituted hydrocarbyl group; and n is 0 or a positive integer; provided that n is not 0 when $R^3$ is hydrogen.

The present invention relates to quaternary ammonium salts and methods and uses relating thereto. This may be referred to herein as "the quaternary ammonium salt" or "the quaternary ammonium compound".

The compound of formula (I) includes a linking group X. In some embodiments X may include one or more carboxylic acid moieties.

By carboxylic acid moiety we mean to include carboxylic acids groups COOH and groups derived there from, for example esters or amides. In embodiments in which X includes one or more carboxylic acid moieties the quaternary ammonium salt of the invention may be prepared from a polycarboxylic acid having more than two carboxylic acid groups, for example pyromellitic acid.

In preferred embodiments X does not include a carboxylic acid moiety and the quaternary ammonium salt is suitably prepared from a dicarboxylic acid or anhydride thereof.

Suitably X is an optionally substituted alkylene or arylene group as is further defined herein. Preferably the quaternary ammonium salt of the invention is a diester or an ester/amide of a dicarboxylic acid.

Suitably the quaternary ammonium salt of the present invention is prepared by reacting:

(a) an optionally substituted dicarboxylic acid or anhydride thereof; with (b) an alcohol of formula $R^3(OR^2)_nOH$;

(c) a reactive alcohol or amine including a tertiary amino group; and (d) a quaternising agent.

Component (a) may be first reacted with component (b), then component (c) and finally component (d). Alternatively component (a) may be reacted first with component (c), then component (b), and then component (d).

In preferred embodiments component (a) is first reacted with component (b) and then with component (c).

The quaternary ammonium salt of the present invention is suitably prepared from a (a) hydrocarbyl substituted dicarboxylic acid or anhydride thereof.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon groups, that is, aliphatic (which may be saturated or unsaturated, linear or branched, e.g., alkyl or alkenyl), alicyclic (e.g., cycloalkyl, cycloalkenyl) substituents, and aromatic (including aliphatic- and alicyclic-substituted aromatic) substituents, as well as cyclic substituents wherein the ring is completed through another portion of the molecule (e.g., two substituents together form a ring);

(ii) substituted hydrocarbon groups, that is, substituents containing non-hydrocarbon groups which, in the context of this invention, do not alter the predominantly hydrocarbon nature of the substituent (e.g., halo (e.g. chloro, fluoro or bromo), hydroxy, alkoxy (e.g. $C_1$ to $C_4$ alkoxy), keto, acyl, cyano, mercapto, amino, amido, nitro, nitroso, sulfoxy, nitryl and carboxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

In this specification, unless otherwise stated references to optionally substituted alkyl groups may include aryl-substituted alkyl groups and references to optionally-substituted aryl groups may include alkyl-substituted or alkenyl-substituted aryl groups.

The additive of the present invention is prepared from a hydrocarbyl substituted dicarboxylic acid or anhydride thereof.

Suitable dicarboxylic acids include maleic acid, glutaric acid, fumaric acid, oxalic acid, malonic acid, pimelic acid, suberic acid, adipic acid, phthalic acid, succinic acid, azelaic acid, sebacic acid and dimerised fatty acids.

In some embodiments the additive is prepared from a dimerised fatty acid. Such compounds are formed from the dimerization of unsaturated fatty acids, for example unsaturated fatty acids having 6 to 50, suitably 8 to 40, preferably 10 to 36, for example 10 to 20 carbon atoms, or 16 to 20 carbon atoms.

Such dimerised fatty acids may have 12-100 carbon atoms, preferably 16-72 carbon atoms such as 20-40 carbon atoms for example 32-40 carbon atoms.

These compounds are well known in the art, particularly for their use as corrosion inhibitors. Particularly preferred dimerised fatty acids are mixtures of C36 dimer acids such as those prepared by dimerising oleic acid, linoleic acid and mixtures comprising oleic and linoleic acid, for example, tall oil fatty acids.

The quaternary ammonium compound of formula (I) includes a linking group X. Preferably X includes a hydrocarbyl substituent. Preferably X is an optionally substituted arylene group or an optionally substituted alkylene group.

In some embodiments the quaternary ammonium salt is prepared from phthalic acid or an anhydride thereof, having the formula (A1) or (A2):

(A1)

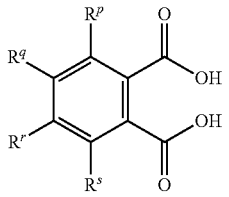

(A2)

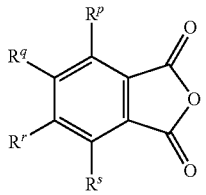

wherein each of $R^p$, $R^q$, $R^r$ and $R^s$ is independently hydrogen or an optionally substituted hydrocarbyl group.

Preferably each is hydrogen or an optionally substituted alkyl or alkenyl group. Preferably three of $R^p$, $R^q$, $R^r$ and $R^s$ are hydrogen and the other is an optionally substituted $C_1$ to $C_{500}$ alkyl or alkenyl group, preferably a $C_2$ to $C_{100}$ alkyl or alkenyl group, preferably a $C_6$ to $C_{50}$ alkyl or alkenyl group, preferably a $C_8$ to $C_{40}$ alkyl or alkenyl group, more preferably a $C_{10}$ to $C_{36}$ alkyl or alkenyl group, preferably a $C_{12}$ to $C_{22}$ alkyl or alkenyl group, suitably a $C_{16}$ to $C_{28}$ alkyl or alkenyl group, for example a $C_{20}$ to $C_{24}$ alkyl or alkenyl group. The alkyl or alkenyl group may be straight chain or branched. Preferably $R^p$, $R^q$ and $R^s$ are hydrogen and $R^r$ is an optionally substituted alkyl or alkenyl group.

X is preferably an optionally substituted hydrocarbylene group. Preferably X is an optionally substituted alkylene or arylene group. Preferably X is an optionally substituted alkylene group. Preferably X is a substituted alkylene group.

Suitably X is an alkyl or alkenyl substituted alkylene group.

Preferably X is an alkyl substituted alkylene group.

Preferably X is an alkyl substituted alkylene group wherein the alkylene group was 1 to 10, preferably 1 to 6, suitably 1 to 4, preferably 2 or 3, and most preferably 2 carbon atoms in the alkylene chain.

In some preferred embodiments X is $CH_2CHR^4$ or $CHR^4CH_2$ wherein $R^4$ is an optionally substituted hydrocarbyl group.

Preferably the quaternary ammonium salt of the present invention is prepared from an optionally substituted succinic acid or anhydride thereof of formula (A3) or (A4):

(A3)

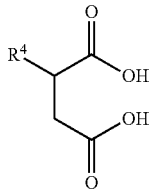

(A4)

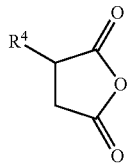

wherein $R^4$ is hydrogen or an optionally substituted hydrocarbyl group. Preferably $R^4$ is an optionally substituted alkyl or alkenyl group.

In some embodiments $R^4$ is an optionally substituted $C_1$ to $C_{500}$ alkyl or alkenyl group, preferably a $C_2$ to $C_{100}$ alkyl or alkenyl group, preferably a $C_6$ to $C_{50}$ alkyl or alkenyl group, preferably a $C_8$ to $C_{40}$ alkyl or alkenyl group, more preferably a $C_{10}$ to $C_{38}$ alkyl or alkenyl group, preferably a $C_{16}$ to $C_{36}$ alkyl or alkenyl group, suitably a $C_{18}$ to $C_{32}$ alkyl or alkenyl group.

$R^4$ may be substituted with one or more groups selected from halo (e.g. chloro, fluoro or bromo), nitro, hydroxy, mercapto, sulfoxy, amino, nitryl, acyl, carboxy, alkyl (e.g. $C_1$ to $C_4$ alkyl), alkoxyl (e.g. $C_1$ to $C_4$ alkoxy), amido, keto, sulfoxy and cyano.

Preferably $R^4$ is an unsubstituted alkyl or alkenyl group. The substituted succinic acid or anhydrides may suitably be prepared by reacting maleic anhydride with an alkene.

In some embodiments the $R^4$ has a molecular weight of from 100 to 5000, preferably from 300 to 4000, suitably from 450 to 2500, for example from 500 to 2000 or from 600 to 1500.

In some embodiments the substituted succinic acid or anhydride thereof may comprise a mixture of compounds including groups $R^4$ of different lengths. In such embodiments any reference to the molecular weight of the group $R^4$ relates to the number average molecular weight for the mixture.

In some embodiments $R^4$ is a polyisobutenyl group, preferably having a number average molecular weight of from 100 to 5000, preferably from 200 to 2000, suitably from 220 to 1300, for example from 240 to 900.

In some embodiments $R^4$ is an alkyl or alkenyl group having 6 to 40 carbon atoms, preferably 10 to 38 carbon atoms, more preferably 16 to 36 carbon atoms, suitably 18 to 26 carbon atoms, for example 20 to 24 carbon atoms.

In some embodiments $R^4$ may be the residue of an internal olefin. In such embodiments the compound of formula (A3) or (A4) is suitably obtained by the reaction of maleic acid with an internal olefin.

An internal olefin as used herein means any olefin containing predominantly a non-alpha double bond that is a beta or higher olefin. Preferably such materials are substantially completely beta or higher olefins, for example containing less than 10% by weight alpha olefin, more preferably less than 5% by weight or less than 2% by weight. Typical internal olefins include Neodene 151810 available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

In some especially preferred embodiments the quaternary ammonium salt of the present invention is prepared from a succinic acid or anhydride having a $C_{10}$ to $C_{30}$, preferably a $C_{20}$ to $C_{24}$ alkyl or alkenyl group.

The quaternary ammonium salt of the present invention may be a compound of formula (IIA) or (IIB):

(IIA)

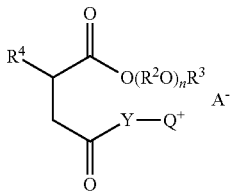

(IIB)

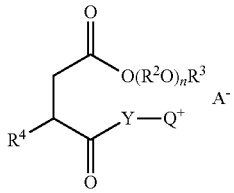

Such a compound may be prepared by reaction with (b) an alcohol of formula $HO(R^2O)_nR^3$.

Suitably n is from 0 to 30, preferably from 1 to 20, suitably from 1 to 16; $R^2$ is an alkylene group having 1 to 12, preferably 1 to 6, more preferably 2 or 3 carbon atoms; and $R^3$ is hydrogen or a $C_1$ to $C_{40}$, preferably a $C_6$ to $C_{30}$, more preferably $C_{10}$ to $C_{20}$ alkyl group; provided n is not 0 when $R^3$ is hydrogen.

$R^3$ is an optionally substituted hydrocarbyl group.

In some embodiments n is 0 and the additive of the invention may be formed from an alcohol of formula $R^3OH$.

In such embodiments $R^3$ is suitably an optionally substituted alkyl, alkenyl or aryl group, preferably having from 1 to 60, preferably from 10 to 40 carbon atoms. Preferably $R^3$ is an optionally substituted alkyl group. In some embodiments $R^3$ is a hydroxy substituted alkyl group.

In some preferred embodiments $R^3$ is an unsubstituted alkyl group. The alkyl group may be straight chained or branched. In some embodiments $R^3$ is an optionally substituted alkyl group having 4 to 40, preferably 6 to 30, more preferably 10 to 20 carbon atoms.

In some embodiments n is 0 and component (b) used to prepare the quaternary ammonium salt is a $C_6$ to $C_{36}$, preferably a $C_{10}$ to $C_{30}$, more preferably a $C_{10}$ to $C_{20}$ optionally substituted alcohol.

In one embodiment component (b) is tetradecanol.

In some embodiments n is 0 and component (b) is an alcohol selected from benzyl alcohol, tetradecanol, butanol, 2-butanol, isobutanol, octanol, 2-ethylhexanol, hexanol, cyclohexanol, cyclooctanol, 2-propylheptanol, isopropanol and 2-ethyl-1-butanol.

In some embodiments n is 0 and component (b) is butanol or 2-ethylhexanol, suitably butanol.

In some embodiments n is not 0 and the quaternary ammonium salt may suitably be formed from an alcohol of formula $HO(R^2O)_nR^3$.

$R^3$ is hydrogen or an optionally substituted hydrocarbyl group.

When $R^3$ is hydrogen component (b) which may be used to prepare the quaternary ammonium salt may be an alkylene glycol or a polyalkylene glycol.

When $R^3$ is not hydrogen, component (a) may be reacted with an alkylene glycol or polyalkylene glycol which is subsequently reacted to form an ether or a compound of formula $HO(R^2O)_nR^3$ may be reacted with component (a).

$R^2$ is an optionally substituted alkylene group. In some embodiments $R^2$ is a hydroxyl substituted alkylene group. Such a group may have 1, 2 or more hydroxyl groups.

For example in some embodiments the additive may be prepared from glycerol, penterythritol or trimethylolpropane.

Preferably $R^2$ is an unsubstituted alkylene group.

Preferably $R^2$ is an optionally substituted alkylene group having 1 to 50 carbon atoms, preferably 1 to 40 carbon atoms, preferably 1 to 30 carbon atoms, more preferably 1 to 20 carbon atoms, suitably 1 to 10 carbon atoms, for example 2 to 6 or 2 to 4 carbon atoms.

Preferably $R^2$ is an unsubstituted alkylene group having 1 to 50 carbon atoms, preferably 1 to 20, more preferably 1 to 10, suitably 2 to 6, for example 2 to 4 carbon atoms. $R^2$ may be straight chained or branched.

Suitably $R^2$ may be an ethylene, propylene, butylene, pentylene, or hexylene group. When R has more than 2 carbon atoms any isomer may be present. Preferably $R^2$ is an ethylene or a propylene group, most preferably a propylene group.

In some embodiments in which n is 1, $R^2$ may be a group of formula $(CH_2)_x$ wherein x is from 2 to 12, preferably from 2 to 6.

In some preferred embodiments $R^2$ is preferably $CR^aR^bCR^cR^d$ and the alcohol (b) has the formula $H—(OCR^aR^bCR^cR^d)_nOR^3$ wherein each of $R^a$, $R^b$, $R^c$ and $R^d$ is independently hydrogen or an optionally substituted alkyl group. Preferably each $R^a$, $R^b$, $R^c$ and $R^d$ is independently selected from hydrogen or an optionally substituted alkyl group having 1 to 20, preferably 1 to 12, more preferably 1 to 4, for example 1 to 2 carbon atoms.

Preferably each of $R^a$, $R^b$, $R^c$ and $R^d$ is independently selected from hydrogen and an unsubstituted alkyl group, preferably having 1 to 20 carbon atoms, suitably 1 to 12 carbon atoms, preferably 1 to 4 atoms, for example 1 or 2 carbon atoms. Preferably at least two of $R^a$, $R^b$, $R^c$ and $R^d$ is hydrogen, more preferably at least three of $R^a$, $R^b$, $R^c$ and $R^d$ is hydrogen.

In some embodiments $R^a$, $R^b$, $R^c$ and $R^d$ are all hydrogen and R is an ethylene group $CH_2CH_2$.

In some embodiments three of $R^a$, $R^b$, $R^c$, and $R^d$ is hydrogen and the other is an unsubstituted alkyl group having 1 to 12, preferably 1 to 4, suitably 1 to 2, and most preferably 1 carbon atoms.

In some embodiments the alcohols (b) used to prepare the quaternary ammonium compounds of the present invention are prepared from epoxides, preferably terminal epoxides.

$R^2$ may comprise a mixture of isomers. For example when $R^2$ is propylene, the polyhydric alcohol may include moieties $—CH_2CH(CH_3)—$ and $—CH(CH_3)CH_2—$ in any order within the chain.

$R^2$ may comprise a mixture of different groups for example ethylene, propylene or butylene units. Block copolymer units are preferred in such embodiments.

$R^2$ is preferably an ethylene, propylene or butylene group. $R^2$ may be an n-propylene or n-butylene group or an isopropylene or isobutylene group. For example R may be $—CH_2CH_2—$, $—CH_2CH(CH_3)—$, $—CH_2C(CH_3)_2$, $—CH(CH_3)CH(CH_3)—$ or $—CH_2CH(CH_2CH_3)—$.

Preferably $R^2$ is ethylene or propylene. More preferably $R^2$ is $—CH_2CH_2—$ or $—CH(CH_3)CH_2—$. Most preferably R is $—CH(CH_3)CH_2—$.

In some embodiments n is at least 1. Preferably n is from 1 to 100, preferably from 1 to 50, more preferably from 1 to 30, more preferably from 1 to 24, preferably from 1 to 20, suitably from 1 to 16, preferably from 1 to 14.

In some embodiments n is from 4 to 10, for example from 6 to 8.

In some embodiments n is from 1 to 6, suitably from 2 to 5, for example 3 or 4.

In some embodiments n is from 8 to 16, for example from 11 to 14.

In some embodiments the quaternary ammonium salt of the present invention is formed from a polyhydric alcohol of formula $HO(R^2O)_nH$ or an ether thereof formula $HO(R^2O)_nR^3$.

In some embodiments the polyhydric alcohol may be a polypropylene glycol having a number average molecular weight of 425.

In some embodiments the polyhydric alcohol may be selected from triethylene glycol, tetraethyelene glycol, propylene glycol, dipropylene glycol and tripropylene glycol.

In some embodiments the polyhydric alcohol may be a polypropylene glycol having a number average molecular weight of 725.

The skilled person will appreciate that commercial sources of alcohols of formula $H—(OR^2)_n—OH$ will often contain mixtures of compounds, for example in which n may be between 6 and 10.

Commercial sources of substituted succinic acids and anhydrides may also contain mixtures of compounds, for example including different compounds with substituents having 20 to 24 carbon atoms.

In some preferred embodiments $R^3$ is hydrogen.

In some embodiments $R^3$ is not hydrogen, n is not 0 and the additive of the invention is prepared from an ether of a polyhydric alcohol, for example an ether of a polyethylene glycol, a polypropylene glycol, triethylene glycol, tetraethylene glycol, propylene glycol, dipropylene glycol or tripropylene glycol.

In some embodiments in which n is not 0, $R^3$ is an optionally substituted alkyl, alkenyl or aryl group, suitably an optionally substituted alkyl or alkenyl group. Preferably $R^3$ has from 4 to 50 carbon atoms, preferably 4 to 40 carbon atoms, more preferably from 10 to 30 carbon atoms. $R^3$ may be straight chain or branched. Preferably $R^3$ is straight chain.

In some embodiments $R^3$ is a substituted alkyl or alkenyl group, suitably a substituted alkyl group. Suitably substituents are hydroxy and ester groups.

Suitably $R^3$ is an unsubstituted alkyl or alkenyl group. Preferably $R^3$ is an alkyl group, preferably an unsubstituted alkyl group.

Suitably $R^3$ is selected from hydrogen, and an alkyl group having from 1 to 40, preferably 6 to 30, more preferably 10 to 20 carbon atoms.

In some embodiments n is from 10 to 40, preferably 15 to 30, more preferably 20 to 25; $R^2$ is ethylene or propylene, most preferably propylene; and $R^3$ is a $C_6$ to $C_{30}$, preferably a $C_{10}$ to $C_{20}$ alkyl group.

Y is selected from 0, NH and $NR^1$ wherein $R^1$ is an optionally substituted hydrocarbyl group. R' is suitably an optionally substituted alkyl or alkenyl group, preferably having 1 to 30, preferably 1 to 20, more preferably 1 to 10. Suitably 1 to 6, for example 1 to 4 carbon atoms.

In one preferred embodiment $R^1$ is methyl.

Preferably Y is O or NH. Most preferably Y is NH.

$Q^+$ is a moiety that includes a quaternary ammonium cation. Suitably $Q^+$ is a group having the formula:

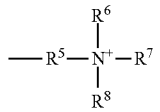

wherein $R^5$ is an optionally substituted alkylene, arylene or alkenylene group and each of $R^6$, $R^7$ and $R^8$ is independently an optionally substituted hydrocarbyl group.

Preferably $R^5$ is an optionally substituted alkylene group, preferably having 1 to 40, preferably 1 to 30, more preferably 1 to 20, suitably 1 to 10, for example 1 to 6 carbon atoms. Most preferably $R^5$ is a propylene group.

$R^6$ is an optionally substituted hydrocarbyl group. Preferably $R^6$ is an optionally substituted alkyl, alkenyl or aryl group. More preferably $R^6$ is an optionally substituted alkyl or alkenyl group, preferably an alkyl group. Most preferably $R^6$ is an unsubstituted alkyl group. Suitably $R^6$ has from 1 to 40 carbon atoms, preferably 1 to 30, more preferably 1 to 20, suitably 1 to 10, for example 1 to 6 carbon atoms. Preferably $R^6$ is a $C_1$ to $C_4$ alkyl group. Most preferably $R^6$ is methyl.

$R^7$ is an optionally substituted hydrocarbyl group. Preferably $R^7$ is an optionally substituted alkyl, alkenyl or aryl group. More preferably $R^7$ is an optionally substituted alkyl or alkenyl group, preferably an alkyl group. Most preferably $R^7$ is an unsubstituted alkyl group. Suitably $R^6$ has from 1 to 40 carbon atoms, preferably 1 to 30, more preferably 1 to 20, suitably 1 to 10, for example 1 to 6 carbon atoms. Preferably $R^7$ is a $C_1$ to $C_4$ alkyl group. Most preferably $R^7$ is methyl.

$R^8$ is an optionally substituted hydrocarbyl group. Preferably $R^8$ is an optionally substituted alkyl, alkenyl or aryl group. Preferably $R^8$ is an optionally substituted alkyl or alkenyl group. Preferably $R^8$ is an optionally substituted alkyl or alkenyl group having 1 to 40 carbon atoms, preferably 1 to 30, more preferably 1 to 20, suitably 1 to 10, for example 1 to 6 carbon atoms. Preferably $R^8$ is an unsubstituted alkyl group or a hydroxy substituted alkyl group.

$R^8$ is suitably provided by a quaternising agent.

The quaternary ammonium compounds of the present invention may be prepared by any suitable method. Such methods are known to the person skilled in the art.

Suitably the quaternary ammonium salts of the present invention are prepared by the reaction of a tertiary amine of formula (III) with a quaternising agent.

(III)

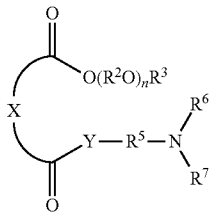

The compound of formula (III) is suitably prepared by the reaction of a hydrocarbyl substituted dicarboxylic acid or anhydride thereof with an alcohol of formula $HO(R^2O)_nR^3$ and a tertiary amine of formula $R^6R^7NR^5YH$; wherein $R^2$ is an optionally substituted alkylene group, $R^3$ is hydrogen or an optionally substituted hydrocarbyl group, $R^5$ is an optionally substituted alkylene, arylene or alkenylene group; X is O or NR'; $R^6$ and $R^7$ is each an optionally substituted hydrocarbyl group; $R^1$ is hydrogen or an optionally substituted hydrocarbyl group; and n is 0 or positive integer provided that when $R^3$ is hydrogen n is not 0.

Preferably each of $R^1$, $R^2$, $R^3$, $R^5$, $R^6$ and $R^7$ are as previously defined herein.

The compound of formula (III) may suitably be provided by reacting (a) a hydrocarbyl substituted dicarboxylic acid or anhydride thereof with (b) an alcohol of formula $R^3(OR^2)_n$ OH and (c) a reactive alcohol or amine including a tertiary amino group.

In some preferred embodiments component (c) is a reactive alcohol including a tertiary amino group.

The reactive alcohol or amine or alcohol including a tertiary amino group suitably have the formula $R^6R^7NR^5YH$.

Suitable reactive amines including a tertiary amino group include N,N-dimethyl-1,3-diaminopropane, N,N-diethyl-1,3-diaminopropane, N,N-dimethylethylenediamine, N,N-diethylethylenediamine, N,N-dibutylethylenediamine and combinations thereof.

Suitable reactive alcohols including a tertiary amino group include triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethylaminoethanol, 2-dimethylamino-2-methyl-1-propanol, dimethyl amino propanol and combinations thereof.

Especially preferred compounds for use as component (c) are dimethylaminopropylamine and dimethylaminopropanol. Most preferred is dimethylaminopropanol.

The quaternary ammonium salts of the present invention may be prepared by reaction of a tertiary amine of formula (III) with a quaternising agent selected from dialkyl sulfates, benzyl halides, hydrocarbyl substituted carbonates, alkyl halides, alkyl sulfonates, sultones, hydrocarbyl substituted phosphates, hydrocarbyl substituted borates, alkyl nitrites, alkyl nitrates, hydroxides, N-oxides or mixtures thereof, followed by an anion exchange reaction.

However in preferred embodiments the quaternary ammonium salt of the present invention is prepared by the reaction of a tertiary amine of formula (III) with a quaternising agent selected from:

(i) an ester of formula $R^9COOR^8$;

(ii) a carbonate compound of formula $R^{10}OCOOR^8$ and then a carboxylic acid of formula $R^9COOH$; and (iii) an epoxide in combination with an acid, preferably a carboxylic acid of formula $R^9COOH$;

wherein $R^8$ is as previously defined herein and $R^9$ is an optionally substituted hydrocarbyl group.

Suitably the anion $A^-$ shown in formula (I) is $R^9COO^-$; wherein $R^9$ is an optionally substituted hydrocarbyl group.

In one embodiment the quaternising agent is (i) an ester of formula $R^9COOR^8$.

In such embodiments $R^8$ is a $C_1$ to $C_7$ alkyl group and $R^9$ is the residue of a carboxylic acid selected from a substituted aromatic carboxylic acid, an α-hydroxycarboxylic acid and a polycarboxylic acid.

In some preferred embodiments the quaternising agent is an ester of a substituted aromatic carboxylic acid and thus $R^9$ is a substituted aryl group.

Especially preferred compounds of this type are lower alkyl esters of salicylic acid such as methyl salicylate, ethyl salicylate, n and i-propyl salicylate, and butyl salicylate, preferably methyl salicylate.

In some embodiments the quaternising agent is an ester of an α-hydroxycarboxylic acid.

Compounds of this type suitable for use herein are described in EP 1254889.

A preferred compound of this type is methyl 2-hydroxyisobutyrate.

In some embodiments the quaternising agent is an ester of a polycarboxylic acid. In this definition we mean to include dicarboxylic acids and carboxylic acids having more than 2 acidic moieties.

One especially preferred compound of this type is dimethyl oxalate.

The ester quaternising agent may be selected from an ester of a carboxylic acid selected from one or more of oxalic acid, phthalic acid, tartaric acid, salicylic acid, maleic acid, malonic acid, citric acid, nitrobenzoic acid, aminobenzoic acid and 2,4,6-trihydroxybenzoic acid.

Preferred ester quaternising agents include dimethyl oxalate, methyl 2-nitrobenzoate, dimethylphthalate, dimethyltartrate and methyl salicylate.

In some embodiments the quaternary ammonium salts are prepared by reacting a compound of formula (III) with (ii) a carbonate of formula $R^{10}OCOOR^9$ and then with a carboxylic acid of formula $R^9COOH$. $R^8$ is as defined above. $R^{10}$ is preferably an optionally substituted alkyl alkenyl or aryl group having up to 30 carbon atoms. Preferably $R^9$ is an optionally substituted alkyl group. Preferably $R^{10}$ is an alkyl group having up to 24 carbon atoms, preferably up to 20 carbon atoms, suitably up to 16 carbon atoms, preferably up to 12 carbon atoms, suitably up to 8, for example up to 6 or up to 4 carbon atoms.

Preferably $R^{10}$ is an unsubstituted alkyl group. In one embodiment $R^{10}$ may be the same or different to $R^8$. Preferably $R^{10}$ is the same as $R^8$. Preferred carbonates are diethyl carbonate and dimethyl carbonate. Dimethyl carbonate is especially preferred. Once the tertiary amine has been reacted with a carbonate quaternising group the resulting salt is then reacted with a carboxylic acid of formula $R^9COOH$ to provide a compound of the first aspect.

The carboxylic acid of formula $R^9COOH$ may be a very small simple molecule. In some embodiments it may be a simple fatty acid compound. However it may also be a more complex molecule including additional acid functional groups.

Examples of suitable small simple acids include formic acid, acetic acid, propionic acid and butyric acid.

Examples of suitable fatty acids include caprylic acid, capris acid, lauric acid, myristic acid, palmitic acid, stearic acid, arachidic acid, behenic acid, lignoceric acid, cerotic acid, myristoleic acid, palmitoleic acid, sapienic acid, oleic acid, elaidic acid, vaccenic acid, linoleic acid, linoelaidic acid, arachidonic acid, eicosapentaenoic acid, erucic acid, undecylenic acid and docosahexenoic acid.

Suitable complex acids include optionally substituted phthalic acid and succinic acid derivatives.

In embodiments in which the acid includes more than one acid functional group the further groups may be present as the free acid or the ester. Where there is more than one free acid group there is suitably an equivalent number of cations.

In some preferred embodiments the quaternising agent is (iii) the combination of an epoxide and an acid. Any suitable organic or inorganic acid may be used. Preferably the acid is a carboxylic acid of formula $R^9COOH$.

One especially preferred acid for use herein is acetic acid.

When the quaternising agent is an (i) an ester of formula $R^9COOR^8$ or (ii) a carbonate of formula $R^{10}OCOOR^8$ and an acid of formula $R^9COOH$, $R^8$ is preferably an alkyl group, preferably methyl or ethyl, most preferably methyl.

When the quaternising agent is (iii) an epoxide in combination with an acid $R^8$ is suitably $CH_2CHOHR^{11}$ wherein $R^{11}$ is hydrogen or an optionally substituted hydrocarbyl group.

Preferably $R^{11}$ is hydrogen or an optionally substituted alkyl or aryl group. $R^{11}$ may have 1 to 40 carbon atoms, suitably 1 to 30, preferably 1 to 20 carbon atoms.

Preferably $R^{11}$ is hydrogen, phenyl or a $C_1$ to $C_{12}$ alkyl group. The alkyl group may include an ester or an ether functional group.

$R^{11}$ may be hydrogen or a $C_1$ to $C_8$, preferably a $C_1$ to $C_6$; more preferably a $C_1$ to $C_4$, for example a $C_2$ or $C_3$ alkyl group.

Preferred epoxides for use as quaternising agents in combination with an acid include ethylene oxide, propylene oxide, butylene oxide, pentylene oxide, hexylene oxide and heptylene oxide. These may be provided as appropriate in any isomeric form or as a mixture of isomers. Also useful are glycidyl ether compounds, for example isopropyl glycidyl ether.

Suitably the epoxide for use as a quaternising agents in combination with an acid may be selected from styrene oxide, ethylene oxide, propylene oxide, butylene oxide, epoxyhexane, octene oxide, stilbene oxide, 2-ethylhexyl glycidyl ether, isopropyl glycidyl ether, 1,2-epoxydodecane and other alkyl and alkenyl epoxides having 2 to 50 carbon atoms.

Especially preferred epoxides are 1,2-epoxy butane and isopropyl glycidyl ether.

Some preferred epoxides are 1,2-epoxydodecane, styrene oxide and butylene oxide, suitably in combination with acetic acid.

The quaternising ammonium compound of the invention of formula (I) may include any anion $A^-$.

$A^-$ may be a polyvalent anion.

Preferred anions are residues of carboxylic acids of formula $R^9COO^-H$. These are suitably as previously defined herein.

In some preferred embodiments $A^-$ is an acetate ion.

In some preferred embodiments X is $CH_2CHR^4$ or $CHR^4CH_2$ wherein $R^4$ is a $C_6$ to $C_{50}$, preferably a $C_{10}$ to $C_{36}$ alkyl group; $R^2$ is ethylene or propylene; n is from 1 to 30, preferably 4 to 20; $R^3$ is hydrogen or $C_4$ to $C_{30}$ alkyl, preferably hydrogen; Y is O or NH, preferably O; $Q^+$ is hydroxyalkyl dialkyl amino alkylene, preferably 2-hydroxybutyl dimethyl amino propylene; and $A^-$ is a carboxylate anion.

In some embodiments the quaternary ammonium compound of the present invention is the reaction product of a succinic acid or anhydride thereof having an alkyl or alkenyl substituent having 6 to 36 carbon atoms; a polyalkylene glycol having a number average molecular weight of 300 to 800 or an ether thereof; a dialkyl aminoalkanol or a dialkylamino alkylamine; and a quaternising agent. In some embodiments the quaternary ammonium salt additive of the invention is the reaction product of a succinic acid or anhydride thereof having an alkyl or alkenyl substituent having 6 to 36 carbon atoms; a polypropylene glycol (or a $C_1$ to $C_{36}$ alkyl ether thereof) having a number average molecular weight of 300 to 800; a dialkylamino alkanol or a dialkylamino amine; and a quaternising agent.

In some embodiments the quaternary ammonium salt additive of the invention is the reaction product of a succinic acid or anhydride thereof having an alkyl or alkenyl substituent having 6 to 36 carbon atoms; a polyhydric alcohol (or a $C_1$ to $C_{36}$ alkyl ether thereof) selected from ethylene glycol, diethylene glycol, triethylene glycol, tetraethylene glycol, propylene glycol, dipropylene glycol, tripropylene glycol and tetrapropylene glycol; a dialkylamino alkanol or a dialkylamino amine; and a quaternising agent.

In some embodiments the quaternary ammonium salt additive of the invention is the reaction product of a succinic acid or anhydride thereof having an alkyl or alkenyl substituent having 6 to 36 carbon atoms; a polyhydric alcohol (or a $C_1$ to $C_{36}$ alkyl ether thereof) selected from glycerol, pentaerythritol and trimethyolpropane; a dialkylamino alkanol or a dialkylamino amine; and a quaternising agent.

In some embodiments the quaternary ammonium salt additive of the invention is the reaction product of a succinic acid or anhydride thereof having an alkyl or alkenyl substituent having 6 to 36 carbon atoms; a polyethylene glycol (or a $C_1$ to $C_{36}$ alkyl ether thereof) having a number average molecular weight of 200 to 800; a dialkylamino alkanol or a dialkylamino amine; and a quaternising agent.

In some embodiments the quaternary ammonium salt additive of the present invention is the reaction product of a succinic acid or anhydride having an alkyl or alkenyl substitutent having 6 to 36 carbon atoms; a polyethylene or polypropylene glycol (or a $C_1$ to $C_{36}$ alkyl ether thereof) having 4 to 20, preferably 4 to 16, more preferably 6 to 8 alkoxy groups; a dialkylamino alkanol or a dialkylamino amine; and a quaternising agent.

In some embodiments the quaternary ammonium salt additive of the invention is the reaction product of a polyisobutenyl substituted succinic acid or anhydride thereof having a PIB substituent with a number average molecular weight of 200 to 2500; a polypropylene glycol (or a $C_1$ to $C_{36}$ alkyl ether thereof) having a number average molecular weight of 300 to 800; a dialkylamino alkanol or a dialkylamino amine; and a quaternising agent.

In some embodiments the quaternary ammonium salt additive of the invention is the reaction product of a polyisobutenyl substituted succinic acid or anhydride thereof having a PIB substituent with a number average molecular weight of 200 to 2500; a polyhydric alcohol (or a $C_1$ to $C_{36}$ alkyl ether thereof) selected from ethylene glycol, diethylene glycol, triethylene glycol, tetraethylene glycol, propylene glycol, dipropylene glycol, tripropylene glycol and tetrapropylene glycol; a dialkylamino alkanol or a dialkylamino amine; and a quaternising agent.

In some embodiments the quaternary ammonium salt additive of the invention is the reaction product of a polyisobutenyl substituted succinic acid or anhydride thereof having a PIB substituent with a number average molecular weight of 200 to 2500; a polyhydric alcohol (or a $C_1$ to $C_{36}$ alkyl ether thereof) selected from glycerol, pentaerythritol and trimethyolpropane; a dialkylamino alkanol or a dialkylamino amine; and a quaternising agent.

In some embodiments the quaternary ammonium salt additive of the invention is a the reaction product of polyisobutenyl substituted succinic acid or anhydride thereof having a PIB substituent with a number average molecular weight of 200 to 2500; a polyethylene glycol (or a $C_1$ to $C_{36}$ alkyl ether thereof) having a number average molecular weight of 200 to 800; a dialkylamino alkanol or a dialkylamino amine; and a quaternising agent.

In some embodiments the quaternary ammonium salt additive of the invention is the reaction product of a polyisobutenyl substituted succinic acid or anhydride thereof having a PIB substituent with a number average molecular weight of 200 to 2500; a polyethylene or polypropylene glycol (or a $C_1$ to $C_{36}$ alkyl ether thereof) having 4 to 16, preferably 6 to 8 alkoxy groups; a dialkylamino alkanol or a dialkylamino amine; and a quaternising agent.

The quaternary ammonium salt of formula (I) is suitably prepared from the reaction of:

(a) an optionally substituted dicarboxylic acid or anhydride thereof; with
(b) an alcohol of formula $R^3(OR^2)_nOH$;
(c) a reactive alcohol or amine including a tertiary amino group; and
(d) a quaternising agent.

Suitably the quaternary ammonium salt is prepared from:

(a) an optionally substituted succinic acid or anhydride thereof;
(b) an alcohol of formula $H(OR^2)_nOH$ or $R^3OH$;
(c) a reactive alcohol including a tertiary amino group; and
(d) a quaternising agent.

Preferably $R^2$ is —$CH(CH_3)CH_2$— and $R^3$ is a $C_2$ to $C_{10}$ alkyl group.

Preferably the quaternary ammonium salt is prepared from:

(a) a succinic acid or anhydride thereof substituted with a $C_{20}$ to $C_{24}$ alkyl or alkenyl group;
(b) a polypropylene glycol or butanol;
(c) dimethylaminopropanol; and
(d) a quaternising agent selected from methyl salicylate, dimethyl oxalate and a hydrocarbyl epoxide in combination with an acid.

Most preferably the quaternising agent is methyl salicylate or dimethyl oxalate.

According to a second aspect of the present invention there is provided a composition comprising a quaternary ammonium salt of formula (I):

(I)

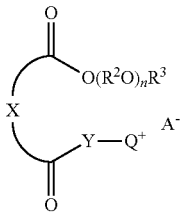

wherein X is a linking group, Y is O, NH or $NR^1$ wherein $R^1$ is H or an optionally substituted hydrocarbyl group; $Q^+$ is a moiety that includes a quaternary ammonium cation; $A^-$ is an anion; $R^2$ is an optionally substituted alkylene group; $R^3$ is hydrogen or an optionally substituted hydrocarbyl group; and n is 0 or a positive integer; provided that n is not 0 when $R^3$ is hydrogen.

Preferred features of the quaternary ammonium salt are as defined in relation to the first aspect.

In some embodiments the composition of the second aspect is an additive composition comprising a quaternary ammonium salt of the first aspect and a diluent or carrier.

The additive composition may be an additive composition for lubricating oil.

Preferably the additive composition is an additive composition for a fuel composition, preferably a diesel duel composition.

The quaternary ammonium compound is suitably present in the additive composition in an amount of from 1 to 99 wt %, for example from 1 to 75 wt %.

The additive composition may comprise a mixture of two or more quaternary ammonium compounds of the present invention. In such embodiments the above amounts suitably refer to the total amount of all such compounds present in the composition.

The additive composition may include one or more further additives. These may be selected from antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers.

In some preferred embodiments the additive composition includes one or more further nitrogen-containing detergents.

The second aspect of the present invention may provide a fuel or lubricating oil composition comprising a quaternary ammonium salt of the first aspect.

In some embodiments the present invention provides a lubricating composition comprising an oil of lubricating viscosity and as an additive a quaternary ammonium salt of formula (I):

(I)

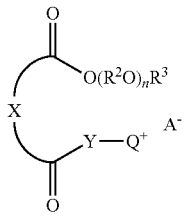

wherein X is a linking group, Y is O, NH or $NR^1$ wherein $R^1$ is H or an optionally substituted hydrocarbyl group; $Q^+$ is a moiety that includes a quaternary ammonium cation; $A^-$ is an anion; $R^2$ is an optionally substituted alkylene group; $R^3$ is hydrogen or an optionally substituted hydrocarbyl group; and n is 0 or a positive integer; provided that n is not 0 when $R^3$ is hydrogen.

In some preferred embodiments the second aspect of the present invention provides a fuel composition comprising as an additive a quaternary ammonium salt of formula (I):

(I)

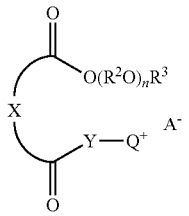

wherein X is a linking group, Y is O, NH or $NR^1$ wherein $R^1$ is H or an optionally substituted hydrocarbyl group; $Q^+$ is a moiety that includes quaternary ammonium cation; $A^-$ is an anion; $R^2$ is an optionally substituted alkylene group; $R^3$ is hydrogen or an optionally substituted hydrocarbyl group; and n is 0 or a positive integer; provided that n is not 0 when $R^3$ is hydrogen.

The present invention may further provide a method of preparing a fuel composition, the method comprising preparing a quaternary ammonium salt of the first aspect, and mixing the quaternary ammonium salt into the fuel.

The fuel composition of the present invention is preferably a diesel fuel composition.

Suitably the quaternary ammonium salt additive is present in the diesel fuel composition in an amount of at least 0.1 ppm, preferably at least 1 ppm, more preferably at least 5 ppm, suitably at least 10 ppm, preferably at least 20 ppm, for example at least 30 ppm or at least 50 ppm.

Suitably the quaternary ammonium salt additive is present in the diesel fuel composition in an amount of less than 10000 ppm, preferably less than 1000 ppm, preferably less than 500 ppm, preferably less than 300 ppm, for example less than 250 ppm.

In some embodiments the quaternary ammonium salt additive is present in the diesel fuel composition in an amount of suitably less than 200 ppm, for example less than 150 ppm.

Suitably the quaternary ammonium salt additive is present in the diesel fuel in an amount of from 80 to 130 ppm.

In this specification any reference to ppm is to parts per million by weight.

The diesel fuel compositions of the present invention may comprise a mixture of two or more quaternary ammonium salt additives. In such embodiments the above amounts refer to the total amounts of all such additives present in the composition.

The use of mixtures may arise due to the availability of starting materials or a particular mixture may be deliberately selected to use in order to achieve a benefit. For example, a particular mixture may lead to improvements in handling, a general improvement in performance or a synergistic improvement in performance.

In this specification any reference to "an additive" or "the additive" of the invention includes embodiments in which a single additive compound is present and embodiments in which two or more additive compounds are present. In embodiments in which two or more compounds are present the mixtures may be present due to a mixture of starting materials being used to prepare the additive compounds (e.g. a mixture of polyhydric alcohols and/or a mixture of polycarboxylic acids and/or a mixture of tertiary amines and/or a mixture of quaternising agents). Alternatively and/or additionally two or more pre-formed compounds of formula (I) may be mixed into a composition, for example a fuel or lubricating composition.

The quaternary ammonium additives may be added to diesel fuel at any convenient place in the supply chain. For example, the additives may be added to fuel at the refinery, at a distribution terminal or after the fuel has left the distribution terminal. If the additive is added to the fuel after it has left the distribution terminal, this is termed an aftermarket application. Aftermarket applications include such circumstances as adding the additive to the fuel in the delivery tanker, directly to a customer's bulk storage tank, or directly to the end user's vehicle tank. Aftermarket applications may include supplying the fuel additive in small bottles suitable for direct addition to fuel storage tanks or vehicle tanks.

By diesel fuel we include any fuel suitable for use in a diesel engine either for road use or non-road use. This includes but is not limited to fuels described as diesel, marine diesel, heavy fuel oil, industrial fuel oil, etc.

The diesel fuel composition used in the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition may comprise non-renewable Fischer-Tropsch fuels such as those described as GTL (gas-to-liquid) fuels, CTL (coal-to-liquid) fuels and OTL (oil sands-to-liquid).

The diesel fuel composition may comprise a renewable fuel such as a biofuel composition or biodiesel composition.

The diesel fuel composition may comprise 1st generation biodiesel. First generation biodiesel contains esters of, for example, vegetable oils, animal fats and used cooking fats. This form of biodiesel may be obtained by transesterification of oils, for example rapeseed oil, soybean oil, canola oil, safflower oil, palm oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, usually in the presence of a catalyst.

The diesel fuel composition may comprise second generation biodiesel. Second generation biodiesel is derived from renewable resources such as vegetable oils and animal fats and processed, often in the refinery, using, for example, hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

The diesel fuel composition may contain blends of any or all of the above diesel fuel compositions.

In some embodiments the diesel fuel composition may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the fuel composition may comprise neat biodiesel.

In some preferred embodiments the fuel composition comprises at least 5 wt % biodiesel.

In some embodiments the fuel composition may comprise a neat GTL fuel.

In some embodiments the diesel fuel composition may comprise a secondary fuel, for example ethanol. Preferably however the diesel fuel composition does not contain ethanol.

The diesel fuel composition used in the present invention may contain a relatively high sulphur content, for example greater than 0.05% by weight, such as 0.1% or 0.2%.

However, in preferred embodiments the diesel fuel composition has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

The diesel fuel composition of the present invention preferably comprises at least 5 wt % biodiesel and less than 50 ppm sulphur.

The diesel fuel composition of the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

In some embodiments the diesel fuel composition may comprise one or more further detergent compounds.

The one or more further detergents may be selected from:

(i) a quaternary ammonium salt additive which is not a compound of formula (I);
(ii) the product of a Mannich reaction between an aldehyde, an amine and an optionally substituted phenol;
(iii) the reaction product of a carboxylic acid-derived acylating agent and an amine;
(iv) the reaction product of a carboxylic acid-derived acylating agent and hydrazine;
(v) a salt formed by the reaction of a carboxylic acid with di-n-butylamine or tri-n-butylamine;
(vi) the reaction product of a hydrocarbyl-substituted dicarboxylic acid or anhydride and an amine compound or salt which product comprises at least one amino triazole group; and
(vii) a substituted polyaromatic detergent additive.

Preferably one or more further detergents are selected from one or more of:

(i) a quaternary ammonium salt additive which is not a compound of formula (I);
(ii) the product of a Mannich reaction between an aldehyde, an amine and an optionally substituted phenol; and
(iii) the reaction product of a carboxylic acid-derived acylating agent and an amine.

The ratio of the quaternary ammonium salt additive to the nitrogen containing detergent is suitable from 5:1 to 1:5, preferably from 2:1 to 1:2.

In some embodiments the diesel fuel composition further comprises (i) a quaternary ammonium salt additive which is not a compound of formula (I).

The further quaternary ammonium salt additive is suitably the reaction product of a nitrogen-containing species having at least one tertiary amine group and a quaternising agent.

The nitrogen containing species may be selected from:

(x) the reaction product of a hydrocarbyl-substituted acylating agent and a compound comprising at least one tertiary amine group and a primary amine, secondary amine or alcohol group;
(y) a Mannich reaction product comprising a tertiary amine group; and
(z) a polyalkylene substituted amine having at least one tertiary amine group.

Examples of quaternary ammonium salt and methods for preparing the same are described in the following patents, which are hereby incorporated by reference, US2008/0307698, US2008/0052985, US2008/0113890 and US2013/031827.

The preparation of some suitable quaternary ammonium salt additives in which the nitrogen-containing species includes component (x) is described in WO 2006/135881 and WO2011/095819.

Component (y) is a Mannich reaction product having a tertiary amine. The preparation of quaternary ammonium salts formed from nitrogen-containing species including component (y) is described in US 2008/0052985.

The preparation of quaternary ammonium salt additives in which the nitrogen-containing species includes component (z) is described for example in US 2008/0113890.

To form the quaternary ammonium salt additive (i) the nitrogen-containing species having a tertiary amine group is reacted with a quaternising agent.

The quaternising agent may suitably be selected from esters and non-esters.

Preferred quaternising agents for use herein include dimethyl oxalate, methyl 2-nitrobenzoate, methyl salicylate and styrene oxide or propylene oxide optionally in combination with an additional acid.

An especially preferred additional quaternary ammonium salt for use herein is formed by reacting methyl salicylate or dimethyl oxalate with the reaction product of a polyisobutylene-substituted succinic anhydride having a PIB number average molecular weight of 700 to 1300 and dimethylaminopropylamine.

Other suitable quaternary ammonium salts include quaternised terpolymers, for example as described in US2011/0258917; quaternised copolymers, for example as described in US2011/0315107; and the acid-free quaternised nitrogen compounds disclosed in US2012/0010112.

Further suitable quaternary ammonium compounds for use in the present invention include the quaternary ammonium compounds described in the applicants copending applications WO2011095819, WO2013/017889, WO2015/011506, WO2015/011507, WO2016/016641 and PCT/GB2016/052312.

In some embodiments the diesel fuel composition used in the present invention comprises from 1 to 500 ppm, preferably 50 to 250 ppm of the quaternary ammonium salt additive of the first aspect and from 1 to 500 ppm, preferably 50 to 250 ppm of a further quaternary ammonium additive (i) which is not a compound of formula (I).

In some embodiments the diesel fuel composition comprises further (ii) the product of a Mannich reaction between an aldehyde, an amine and an optionally substituted phenol. This Mannich reaction product is suitably not a quaternary ammonium salt.

Preferably the aldehyde component used to prepare the Mannich additive is an aliphatic aldehyde. Preferably the aldehyde has 1 to 10 carbon atoms. Most preferably the aldehyde is formaldehyde.

Suitable amines for use in preparing the Mannich additive include monoamines and polyamines. One suitable monoamine is butylamine.

The amine used to prepare the Mannich additive is preferably a polyamine. This may be selected from any compound including two or more amine groups. Preferably the polyamine is a polyalkylene polyamine, preferably a polyethylene polyamine. Most preferably the polyamine comprises tetraethylenepentamine or ethylenediamine.

The optionally substituted phenol component used to prepare the Mannich additive may be substituted with 0 to 4 groups on the aromatic ring (in addition to the phenol OH). For example it may be a hydrocarbyl-substituted cresol. Most preferably the phenol component is a mono-substituted phenol. Preferably it is a hydrocarbyl substituted phenol. Preferred hydrocarbyl substituents are alkyl substituents having 4 to 28 carbon atoms, especially 10 to 14 carbon atoms. Other preferred hydrocarbyl substituents are polyalkenyl substituents. Such polyisobutenyl substituents having a number average molecular weight of from 400 to 2500, for example from 500 to 1500.

In some embodiments the diesel fuel composition of the present invention comprises from 1 to 500 ppm, preferably 50 to 250 ppm of the quaternary ammonium salt additive of the invention and from 1 to 500 ppm, preferably 50 to 250 ppm of a Mannich additive (ii).

In some embodiments the diesel fuel composition further comprises (iii) the reaction product of a carboxylic acid-derived acylating agent and an amine.

These may also be referred to herein in general as acylated nitrogen-containing compounds.

Suitable acylated nitrogen-containing compounds may be made by reacting a carboxylic acid acylating agent with an amine and are known to those skilled in the art.

Preferred hydrocarbyl substituted acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention.

Especially preferred PIBSAs are those having a PIB molecular weight (Mn) of from 300 to 2800, preferably from 450 to 2300, more preferably from 500 to 1300.

In preferred embodiments the reaction product of the carboxylic acid derived acylating agent and an amine includes at least one primary or secondary amine group.

A preferred acylated nitrogen-containing compound for use herein is prepared by reacting a poly(isobutene)-substituted succinic acid-derived acylating agent (e.g., anhydride, acid, ester, etc.) wherein the poly(isobutene) substituent has a number average molecular weight (Mn) of between 170 to 2800 with a mixture of ethylene polyamines having 2 to about 9 amino nitrogen atoms, preferably about 2 to about 8 nitrogen atoms, per ethylene polyamine and about 1 to about 8 ethylene groups. These acylated nitrogen compounds are suitably formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. Acylated amino compounds of this type and their preparation are well known to those skilled in the art and are described in for example EP0565285 and U.S. Pat. No. 5,925,151.

In some preferred embodiments the composition comprises a detergent of the type formed by the reaction of a polyisobutene-substituted succinic acid-derived acylating agent and a polyethylene polyamine. Suitable compounds are, for example, described in WO2009/040583.

In some embodiments the diesel fuel composition of the present invention comprises from 1 to 500 ppm, preferably 50 to 250 ppm of the quaternary ammonium salt ester additive and from 1 to 500 ppm, preferably 50 to 250 ppm of an additive which is the reaction product of an acylating agents and an amine (iii).

In some embodiments the diesel fuel composition comprises (iv) the reaction product of a carboxylic acid-derived acylating agent and hydrazine.

Suitably the additive comprises the reaction product between a hydrocarbyl-substituted succinic acid or anhydride and hydrazine.

Preferably, the hydrocarbyl group of the hydrocarbyl-substituted succinic acid or anhydride comprises a $C_8$-$C_{36}$ group, preferably a $C_8$-$C_{18}$ group. Alternatively, the hydrocarbyl group may be a polyisobutylene group with a number average molecular weight of between 200 and 2500, preferably between 800 and 1200.

Hydrazine has the formula $NH_2$—$NH_2$. Hydrazine may be hydrated or non-hydrated. Hydrazine monohydrate is preferred.

The reaction between the hydrocarbyl-substituted succinic acid or anhydride and hydrazine produces a variety of products, such as is disclosed in US 2008/0060259.

In some embodiments the diesel fuel composition further comprises (v) a salt formed by the reaction of a carboxylic acid with di-n-butylamine or tri-n-butylamine. Exemplary compounds of this type are described in US 2008/0060608.

Such additives may suitably be the di-n-butylamine or tri-n-butylamine salt of a fatty acid of the formula $[R'(COOH)_x]_y$, where each R' is a independently a hydrocarbon group of between 2 and 45 carbon atoms, and x is an integer between 1 and 4.

In a preferred embodiment, the carboxylic acid comprises tall oil fatty acid (TOFA).

Further preferred features of additives of this type are described in EP1900795.

In some embodiments the diesel fuel composition further comprises (vi) the reaction product of a hydrocarbyl-substituted dicarboxylic acid or anhydride and an amine compound or salt which product comprises at least one amino triazole group.

Further preferred features of additive compounds of this type are as defined in US2009/0282731.

In some embodiments the diesel fuel composition further comprises (vii) a substituted polyaromatic detergent additive.

One preferred compound of this type is the reaction product of an ethoxylated naphthol and paraformaldehyde which is then reacted with a hydrocarbyl substituted acylating agent.

Further preferred features of these detergents are described in EP1884556.

The quaternary ammonium salt additives of the present invention have been found to be effective at controlling deposits in fuel and lubricating compositions.

The present invention may provide the use of a quaternary ammonium compound of the first aspect as an additive for fuel or lubricating oil compositions.

The present invention may provide the use of a quaternary ammonium compound of the first aspect as a deposit control additive for fuel or lubricating oil compositions.

The present invention may provide the use of a quaternary ammonium compound of the first aspect as a deposit control additive for lubricating oil compositions.

The present invention may provide the use of a quaternary ammonium compound of the first aspect as a deposit control additive for fuel compositions.

The present invention may provide the use of a quaternary ammonium compound of the first aspect as a deposit control additive for diesel fuel compositions.

The present invention may provide the use of a quaternary ammonium compound of the first aspect as a deposit control additive for diesel fuel compositions.

According to a third aspect of the present invention there is provided the use of a quaternary ammonium salt as an additive in a fuel or lubricating composition; wherein the quaternary ammonium salt has the formula (I):

(I)

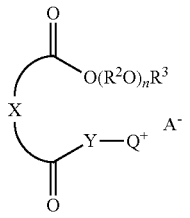

wherein X is a linking group, Y is O, NH or $NR^1$ wherein $R^1$ is H or an optionally substituted hydrocarbyl group; $Q^+$ is a moiety that includes a quaternary ammonium cation; $A^-$ is an anion; $R^2$ is an optionally substituted alkylene group; $R^3$ is hydrogen or an optionally substituted hydrocarbyl group; and n is 0 or a positive integer; provided that n is not 0 when $R^3$ is hydrogen.

The quaternary ammonium salt of the third aspect is preferably as defined in relation to the first aspect, and the fuel or lubricating composition is preferably as defined in relation to the second aspect.

The use of the third aspect preferably relates to use of the quaternary ammonium salt as a fuel additive, preferably a diesel fuel additive.

Preferably the use of the third aspect relates to the use of the quaternary ammonium salt of the first aspect as a detergent additive.

The third aspect of the present invention may provide the use of a quaternary ammonium compound of formula (I) to improve the performance of an engine. The use is suitably achieved when a composition comprising the quaternary ammonium compound is combusted in the engine.

Preferably the engine is a diesel engine.

According to a fourth aspect of the present invention there is provided a method of improving the performance of an engine, the method comprising combusting in the engine a fuel composition comprising as an additive a quaternary ammonium salt of formula (I):

(I)

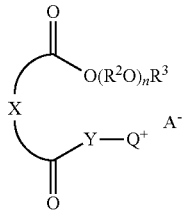

wherein X is a linking group, Y is O, NH or $NR^1$ wherein $R^1$ is H or an optionally substituted hydrocarbyl group; $Q^+$ is a moiety that includes a quaternary ammonium cation; $A^-$ is an anion; $R^2$ is an optionally substituted alkylene group; $R^3$ is hydrogen or an optionally substituted hydrocarbyl group; and n is 0 or a positive integer; provided n is not 0 when $R^3$ is hydrogen.

The method of the fourth aspect preferably involves combusting in the engine a composition of the second aspect.

The present invention relates to improving the performance of diesel engines by combusting diesel fuel compositions comprising a quaternary ammonium salt additive.

Preferably the method of the fourth aspect is achieved by combusting in the engine a quaternary ammonium salt additive which functions as a detergent.

Preferably the fourth aspect of the present invention provides a method of combatting deposits in an engine.

The third aspect of the present invention relates to the use of the quaternary ammonium salt additive as an additive in a fuel or lubricating composition.

Preferably the third aspect relates to the use of the quaternary ammonium salt as a detergent additive.

Preferably the use relates to the use in a fuel composition, preferably a diesel composition.

Preferably the use of the third aspect provides the use of the quaternary ammonium salt as an additive in a diesel fuel composition in a diesel engine.

Suitably the use of the third aspect of the invention improves the performance of the engine.

This improvement in performance may, for example, be achieved by combatting deposits in the engine.

References herein to improving performance and/or combating deposits may apply to either the third and/or the fourth aspect of the invention.

Preferably the engine is a diesel engine.

The quaternary ammonium salt additives used in the present invention have been found to be particularly effective in modern diesel engines having a high pressure fuel system. Some features of engines of this type have been previously described herein.

Suitably the present invention combats deposits and/or improves performance of a diesel engine having a high pressure fuel system. Suitably the diesel engine has a pressure in excess of 1350 bar ($1.35\times10^8$ Pa). It may have a pressure of up to 2000 bar ($2\times10^8$ Pa) or more.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurising the fuel, the fuel gets hot, often to temperatures around 100° C., or above.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues, lacquers or sticky or gum-like residues. Diesel fuels become more and more unstable the more they are heated, particularly if heated under pressure. Thus diesel engines having high pressure fuel systems may cause increased fuel degradation. In recent years the need to reduce emissions has led to the continual redesign of injection systems to help meet lower targets. This has led to increasingly complex injectors and lower tolerance to deposits.

The problem of injector fouling may occur when using any type of diesel fuels. However, some fuels may be particularly prone to cause fouling or fouling may occur more quickly when these fuels are used. For example, fuels containing biodiesel and those containing metallic species may lead to increased deposits.

When injectors become blocked or partially blocked, the delivery of fuel is less efficient and there is poor mixing of the fuel with the air. Over time this leads to a loss in power of the engine, increased exhaust emissions and poor fuel economy.

Deposits are known to occur in the spray channels of the injector, leading to reduced flow and power loss. As the size of the injector nozzle hole is reduced, the relative impact of deposit build up becomes more significant. Deposits are also known to occur at the injector tip. Here, they affect the fuel spray pattern and cause less effective combustion and associated higher emissions and increased fuel consumption.

In addition to these "external" injector deposits in the nozzle hole and at the injector tip which lead to reduced flow and power loss, deposits may occur within the injector body causing further problems. These deposits may be referred to as internal diesel injector deposits (or IDIDs). IDIDs occur inside the injector on the critical moving parts. They can hinder the movement of these parts affecting the timing and quantity of fuel injection. Since modern diesel engines operate under very precise conditions these deposits can have a significant impact on performance.

IDIDs cause a number of problems, including power loss and reduced fuel economy due to less than optimal fuel metering and combustion. Initially the user may experience cold start problems and/or rough engine running. These deposits can lead to more serious injector sticking. This occurs when the deposits stop parts of the injector from moving and thus the injector stops working. When several or all of the injectors stick the engine may fail completely.

The CEC have recently introduced an Internal Diesel Injector Deposit Test, CEC F-110-16, to discriminate between fuels that differ in their ability to produce IDIDs in direct injection common rail diesel engines.

As mentioned above, the problem of injector fouling may be more likely to occur when using fuel compositions comprising metal species. Various metal species may be present in fuel compositions. This may be due to contamination of the fuel during manufacture, storage, transport or use or due to contamination of fuel additives. Metal species may also be added to fuels deliberately. For example transition metals are sometimes added as fuel borne catalysts, for example to improve the performance of diesel particulate filters.

Problems of injector sticking may occur when metal or ammonium species, particularly sodium species, react with carboxylic acid species in the fuel.

Sodium contamination of diesel fuel and the resultant formation of carboxylate salts is believed to be a major cause of injector sticking.

In some embodiments the diesel fuel compositions used in the present invention comprise sodium and/or calcium.

Suitably they comprise sodium. The sodium and/or calcium is typically present in a total amount of from 0.01 to 50 ppm, preferably from 0.05 to 5 ppm preferably 0.1 to 2 ppm such as 0.1 to 1 ppm.

Other metal-containing species may also be present as a contaminant, for example through the corrosion of metal and metal oxide surfaces by acidic species present in the fuel or from lubricating oil.

In use, fuels such as diesel fuels routinely come into contact with metal surfaces for example, in vehicle fuelling systems, fuel tanks, fuel transportation means etc. Typically, metal-containing contamination may comprise transition metals such as zinc, iron and copper; Group I or Group II metals and other metals such as lead.

The presence of metal containing species may give rise to fuel filter deposits and/or external injector deposits including injector tip deposits and/or nozzle deposits.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the diesel fuel may comprise metal-containing species comprising a fuel-borne catalyst. Preferably, the fuel borne catalyst comprises one or more metals selected from iron, cerium, platinum, manganese, Group I and Group II metals e.g., calcium and strontium. Most preferably the fuel borne catalyst comprises a metal selected from iron and cerium.

In some embodiments, the diesel fuel may comprise metal-containing species comprising zinc. Zinc may be present in an amount of from 0.01 to 50 ppm, preferably from 0.05 to 5 ppm, more preferably 0.1 to 1.5 ppm.

Typically, the total amount of all metal-containing species in the diesel fuel, expressed in terms of the total weight of metal in the species, is between 0.1 and 50 ppm by weight, for example between 0.1 and 20 ppm, preferably between 0.1 and 10 ppm by weight, based on the weight of the diesel fuel.

It is advantageous to provide a diesel fuel composition which prevents or reduces the occurrence of deposits in a diesel engine. In some embodiments such deposits may include "external" injector deposits such as deposits in and around the nozzle hole and at the injector tip. In some preferred embodiments the deposits include "internal" injector deposits or IDIDs. Such fuel compositions may be considered to perform a "keep clean" function i.e. they prevent or inhibit fouling. It is also be desirable to provide a diesel fuel composition which would help clean up deposits of these types. Such a fuel composition which when combusted in a diesel engine removes deposits therefrom thus effecting the "clean-up" of an already fouled engine.

As with "keep clean" properties, "clean-up" of a fouled engine may provide significant advantages. For example, superior clean up may lead to an increase in power and/or an increase in fuel economy. In addition removal of deposits from an engine, in particular from injectors may lead to an increase in interval time before injector maintenance or replacement is necessary thus reducing maintenance costs.

Although for the reasons mentioned above deposits in injectors is a particular problem found in modern diesel engines with high pressure fuels systems, it is desirable to provide a diesel fuel composition which also provides effective detergency in older traditional diesel engines such that a single fuel supplied at the pumps can be used in engines of all types.

It is also desirable that fuel compositions reduce the fouling of vehicle fuel filters. It is useful to provide compositions that prevent or inhibit the occurrence of fuel filter deposits i.e. provide a "keep clean" function. It is useful to provide compositions that remove existing deposits from fuel filter deposits i.e. provide a "clean up" function. Compositions able to provide both of these functions are especially useful.

The method of the present invention is particularly effective at combatting deposits in a modern diesel engine having a high pressure fuel system.

Such diesel engines may be characterised in a number of ways.

Such engines are typically equipped with fuel injection equipment meeting or exceeding "Euro 5" emissions legislation or equivalent legislation in the US or other countries.

Such engines are typically equipped with fuel injectors having a plurality of apertures, each aperture having an inlet and an outlet.

Such engines may be characterised by apertures which are tapered such that the inlet diameter of the spray-holes is greater than the outlet diameter.

Such modern engines may be characterised by apertures having an outlet diameter of less than 500 μm, preferably less than 200 μm, more preferably less than 150 μm, preferably less than 100 μm, most preferably less than 80 μm or less.

Such modern diesel engines may be characterised by apertures where an inner edge of the inlet is rounded.

Such modern diesel engines may be characterised by the injector having more than one aperture, suitably more than 2 apertures, preferably more than 4 apertures, for example 6 or more apertures.

Such modern diesel engines may be characterised by an operating tip temperature in excess of 250° C.

Such modern diesel engines may be characterised by a fuel injection system which provides a fuel pressure of more than 1350 bar, preferably more than 1500 bar, more preferably more than 2000 bar.

Preferably, the diesel engine has fuel injection system which comprises a common rail injection system.

The method of the present invention preferably combats deposits in an engine having one or more of the above-described characteristics.

The use of the present invention preferably improves the performance of an engine. This improvement in performance is suitably achieved by reducing deposits in the engine.

The first aspect of the present invention relates to a method of combating deposits in a diesel engine. Combating deposits may involve reducing or the preventing of the formation of deposits in an engine compared to when running the engine using unadditised fuel. Such a method may be regarded as achieving "keep clean" performance.

Combating deposits may involve the removal of existing deposits in an engine. This may be regarded as achieving "clean up" performance.

In especially preferred embodiments the method of the first aspect and the use of the second aspect of the present invention may be used to provide "keep clean" and "clean up" performance.

As explained above deposits may occur at different places within a diesel engine, for example a modern diesel engine.

The present invention is particularly useful in the prevention or reduction or removal of internal deposits in injectors of engines operating at high pressures and temperatures in which fuel may be recirculated and which comprise a plurality of fine apertures through which the fuel is delivered to the engine. The present invention finds utility in engines for heavy duty vehicles and passenger vehicles. Passenger vehicles incorporating a high speed direct injection (or HSDI) engine may for example benefit from the present invention.

The present invention may also provide improved performance in modern diesel engines having a high pressure fuel system by controlling external injector deposits, for example those occurring in the injector nozzle and/or at the injector tip. The ability to provide control of internal injector deposits and external injector deposits is a useful advantage of the present invention.

Suitably the present invention may reduce or prevent the formation of external injector deposits. It may therefore provide "keep clean" performance in relation to external injector deposits.

Suitably the present invention may reduce or remove existing external injector deposits. It may therefore provide "clean up" performance in relation to external injector deposits.

Suitably the present invention may reduce or prevent the formation of internal diesel injector deposits. It may therefore provide "keep clean" performance in relation to internal diesel injector deposits.

Suitably the present invention may reduce or remove existing internal diesel injector deposits. It may therefore provide "clean up" performance in relation to internal diesel injector deposits.

The present invention may also combat deposits on vehicle fuel filters. This may include reducing or preventing the formation of deposits ("keep clean" performance) or the reduction or removal of existing deposits ("clean up" performance).

The removal or reduction of IDIDs according to the present invention will lead to an improvement in performance of the engine.

The improvement in performance of the diesel engine system may be measured by a number of ways.

Suitable methods will depend on the type of engine and whether "keep clean" and/or "clean up" performance is measured.

An improvement in "keep clean" performance may be measured by comparison with a base fuel. "Clean up" performance can be observed by an improvement in performance of an already fouled engine.

The effectiveness of fuel additives is often assessed using a controlled engine test.

In Europe the Co-ordinating European Council for the development of performance tests for transportation fuels, lubricants and other fluids (the industry body known as CEC), has developed a test for additives for modern diesel engines such as HSDI engines. The CEC F-98-08 test is used to assess whether diesel fuel is suitable for use in engines meeting new European Union emissions regulations known as the "Euro 5" regulations. The test is based on a Peugeot DW10 engine using Euro 5 injectors, and is commonly referred to as the DW10B test. This test measures power loss in the engine due to deposits on the injectors, and is further described in example 4.

Preferably the use of the fuel composition of the present invention leads to reduced deposits in the DW10B test. For "keep clean" performance a reduction in the occurrence of deposits is preferably observed.

For "clean up" performance removal of deposits is preferably observed. The DW10B test is used to measure the power loss in modern diesel engines having a high pressure fuel system.

Suitably the use of a fuel composition of the present invention may provide a "keep clean" performance in modern diesel engines, that is the formation of deposits in the injectors of these engines may be inhibited or prevented. Preferably this performance is such that a power loss of less than 5%, preferably less than 2% is observed after 32 hours as measured by the DW10B test.

Suitably the use of a fuel composition of the present invention may provide a "clean up" performance in modern diesel engines that is, deposits on the injectors of an already fouled engine may be removed. Preferably this performance is such that the power of a fouled engine may be returned to within 1% of the level achieved when using clean injectors within 16 hours, preferably 12 hours, more preferably 8 hours as measured in the DW10B test.

In some preferred embodiments, clean up may also provide a power increase. Thus a fouled engine may be treated to remove the existing deposits and provide an additional power gain.

Clean injectors can include new injectors or injectors which have been removed and physically cleaned, for example in an ultrasound bath.

The CEC have also developed a new test, commonly known as the DW10C which assesses the ability of a fuel composition to prevent the formation of IDIDs that lead to injector sticking. This test is described in example 3. A modified version of this test adapted to measure clean up, is described in example 4.

The DW10C test may be used to measure the "keep clean" or "clean up" performance of an engine.

In some embodiments the present invention provides a "keep clean" performance in relation to the formation of IDIDs. Such performance may be illustrated by achieving a merit score of at least 7 as measured by the DW10C test, preferably at least 8, more preferably at least 9.

In some embodiments a merit score of at least 9.3 may be achieved, for example at least 9.4, at least 9.5, at least 9.6 or at least 9.7.

In some embodiments the present invention provides a "clean-up" performance in relation to IDIDs, whereby existing IDIDs may be removed. Such a performance is illustrated in the examples.

The diesel fuel compositions of the present invention may also provide improved performance when used with traditional diesel engines. Preferably the improved performance is achieved when using the diesel fuel compositions in modern diesel engines having high pressure fuel systems and when using the compositions in traditional diesel engines. This is important because it allows a single fuel to be provided that can be used in new engines and older vehicles.

For older engines an improvement in performance may be measured using the XUD9 test. This test is described in relation to example 5.

Suitably the use of a fuel composition of the present invention may provide a "keep clean" performance in traditional diesel engines, that is the formation of deposits on the injectors of these engines may be inhibited or prevented. Preferably this performance is such that a flow loss of less than 50%, preferably less than 30% is observed after 10 hours as measured by the XUD-9 test.

Suitably the use of a fuel composition of the present invention may provide a "clean up" performance in traditional diesel engines, that is deposits on the injectors of an already fouled engine may be removed. Preferably this performance is such that the flow loss of a fouled engine may be reduced by 10% or more within 10 hours as measured in the XUD-9 test.

The benefits provided by the present invention mean that engines need to be serviced less frequently, leading to cost savings and an increase in maintenance intervals.

Preferably the method and use of the present invention provide an improvement in the performance of a diesel engine. This improvement in performance is suitably selected from one or more of:

a reduction in power loss of the engine;
a reduction in external diesel injector deposits;
a reduction in internal diesel injector deposits;
an improvement in fuel economy;
a reduction in fuel filter deposits;
a reduction in emissions; and
an increase in maintenance intervals.

The additives of the present invention may provide a further benefit in addition to those listed above. For example the additive may provide lubricity benefits and/or corrosion inhibition and/or cold flow improvement.

As mentioned above, the diesel fuel compositions used in the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

In some embodiments the combination of a quaternary ammonium salt additive of the invention and a further additive may provide synergistic improvement in performance.

For example the use of a quaternary ammonium salt additive of the invention in combination with a cold flow improver may provide an unexpected improvement in detergency and/or cold flow performance compared with the performance of the individual additives used alone.

In some embodiments the use of a quaternary ammonium salt additive of the present invention may enable a lower treat rate of cold flow improver to be used.

For example the use of a quaternary ammonium salt additive of the invention in combination with a corrosion inhibitor may provide an unexpected improvement in detergency and/or corrosion inhibition compared with the performance of the individual additives used alone.

In some embodiments the use of a quaternary ammonium salt additive of the present invention may enable a lower treat rate of corrosion inhibitor to be used.

For example the use of a quaternary ammonium salt additive of the invention in combination with a lubricity improver may provide an unexpected improvement in detergency and/or lubricity compared with the performance of the individual additives used alone.

In some embodiments the use of a quaternary ammonium salt additive of the present invention may enable a lower treat rate of lubricity improver to be used.

In some preferred embodiments the diesel fuel composition of the present invention comprises one or more further detergents. Nitrogen-containing detergents are preferred.

The one or more further detergents may provide a synergistic benefit such that an improved performance is observed when using the combination of an ester additive of the invention and a nitrogen-containing detergent compared to the use of an equivalent amount of either additive alone.

The use of a combination of a quaternary ammonium salt additive and a further nitrogen-containing detergent which is not a compound of formula (I) may also combat deposits and improve performance in a traditional diesel engine.

The invention will now be further described with reference to the following non-limiting examples. In the examples which follow the values given in parts per million (ppm) for treat rates denote active agent amount, not the amount of a formulation as added, and containing an active agent. All parts per million are by weight.

Example 1

Additive A1, an additive of the invention was prepared as follows:

A mixture of alkenes having 20 to 24 carbon atoms was heated with 1.2 molar equivalents of maleic anhydride. On completion of the reaction excess maleic anhydride was removed by distillation. The anhydride value of the substituted succinic anhydride product was measured as 2.591 $mmolg^{-1}$.

This product was then heated with one molar equivalent of polypropylene glycol having a number average molecular weight of 425, and the reaction was monitored by FTIR.

The resultant material was reacted with one molar equivalent dimethyl aminopropanol at 140° C. in xylene and the reaction monitored until constant acid valve and FTIR spectra were obtained. Volatiles were then removed in vacuo to afford a mixed diester.

This mixed diester product was reacted with 1.5 molar equivalents of butylene oxide, 6 molar equivalents of water and one molar equivalents of acetic acid at 60° C. in toluene for 6 hours. Volatiles were removed in vacuo to provide the quaternary ammonium salt A1.

Additive A2 was prepared using a method analogous to that used to prepare additive A1 except that tripropylene glycol was used in place of polypropylene glycol.

Additive A3 was prepared using a method analogous to that used to prepare additive A1 except that polyethylene glycol having a number average molecular weight of 400 was used in place of the polypropylene glycol.

Additive A4 was prepared using a method analogue to that used to prepare additive A1 except that in the last step the diester was reacted with one molar equivalent of dimethyl oxalate in place of the butylene oxide/acetic acid.

Additive A5 was prepared using a method analogous to the preparation of additive A2 except in the last step the diester was reacted with one molar equivalent of dimethyl oxalate in place of the butylene oxide/acetic acid.

Additive A6 was prepared using a method analogous to that used in the preparation of additive A3 except in the last step the diester was reacted with one molar equivalent of dimethyl oxalate in place of the butylene oxide/acetic acid.

Additive A7 was prepared using a method analogous to that used to prepare additive A1 except that in the last step 1 molar equivalent of methyl salicylate was used as the quaternising agent.

Additive A8 was prepared using a method analogous to the preparation of additive A2 except that in the last step 1 molar equivalents of methyl salicylate was used as the quaternising agent.

Additive A9 was prepared using a method analogous to that used in the preparation of additive A3 except that in the last step 1 molar equivalents of methyl salicylate was used as the quaternising agent.

The reagents used in the preparation of additives A1 to A9 are summarised in the table below and further additives prepared from polyisobutenyl substituted succinic acid derivatives and other amines, alcohols and quaternising agents are also listed in table 1. Compounds A10 to A15 were prepared by methods analogous to those described in relation to compounds A1 to A9.

TABLE 1

| Example No | Succinic anhydride substituent | Alcohol | Amine | Quaternising agent |
|---|---|---|---|---|
| A1 | C20-24 | Poly(propylene glycol) Mn425 | N,N-dimethylamino propanol | Butylene oxide + acetic acid |
| A2 | C20-24 | Poly(propylene glycol) Mn425 | N,N-dimethylamino propanol | Butylene oxide + acetic acid |
| A3 | C20-24 | Poly(ethylene glycol) Mn400 | N,N-dimethylamino propanol | Butylene oxide + acetic acid |
| A4 | C20-24 | Poly(propylene glycol) Mn425 | N,N-dimethylamino propanol | Dimethyl oxalate |
| A5 | C20-24 | tri(propylene glycol) | N,N-dimethylamino propanol | Dimethyl oxalate |
| A6 | C20-24 | Poly(ethylene glycol) Mn400 | N,N-dimethylamino propanol | Dimethyl oxalate |
| A7 | C20-24 | Poly(propylene glycol) Mn425 | N,N-dimethylamino propanol | Methyl Salicylate |
| A8 | C20-24 | tri(propylene glycol) | N,N-dimethylamino propanol | Methyl Salicylate |
| A9 | C20-24 | Poly(ethylene glycol) Mn400 | N,N-dimethylamino propanol | Methyl Salicylate |
| A10 | 1000PIB | Poly(ethlylene glycol) 600 | N,N-dimethylamino propylamine | Methyl Salicylate |
| A11 | 1000PIB | Tri-decanol•$(PO)_{15}$ | N,N-dimethylamino propanol | 1,2-epoxydodecane + acetic acid |
| A12 | 1000PIB | Poly(propylene glycol) Mn425 | N,N-dimethylamino propanol | Butylene oxide + acetic acid |
| A13 | 1000PIB | Tri-decanol•$(PO)_{15}$ | N,N-dimethylamino propanol | Styrene oxide + acetic acid |
| A14 | 550PIB | tri(propylene glycol) | N,N-dimethylamino propanol | Methyl Salicylate |
| A15 | 1000PIB | tri(propylene glycol) | N,N-dimethylamino propanol | Methyl Salicylate |

"Tridecanol•$(PO)_{15}$" is the reaction product of a $C_{13}$ alkanol and an average of 15 moles of propylene oxide per molecule.

Example 2

Diesel fuel compositions were prepared by dosing additives to aliquots all drawn from a common batch of RF06 base fuel, as detailed in table 1.

The compositions were tested in a screening test which correlates with performance at combatting IDIDs as measured in the DW10C test.

In this test a fuel composition is tested using a Jet Fuel Thermal Oxidation Test equipment. In this modified test 800 ml of fuel is flowed over a heated tube at pressures of approximately 540 psi. The test duration is 2.5 hours. At the end of the test the amount of deposit obtained on the tube is compared to a reference value.

The value shown in table 2 is the percentage reduction in deposit thickness compared to base fuel.

TABLE 2

| Compound | ppm active | Average thickness (% reduction) |
|---|---|---|
| A2 (inventive) | 120 | 64 |
| A5 (inventive) | 120 | 80 |
| A14 (inventive) | 120 | 70 |
| C1 (comparative) | 120 | 0 |
| C2 (comparative) | 120 | 2 |

Comparative additive C1 is dodecenyl substituted succinic acid.

Comparative additive C2 is a polyisobutenyl (PIB) substituted succinic acid where PIB has a number average molecular weight of 1000.

Table 3 below shows the specification for RF06 base fuel.

TABLE 3

| Property | Units | Limits Min | Limits Max | Method |
|---|---|---|---|---|
| Cetane Number | | 52.0 | 54.0 | EN ISO 5165 |
| Density at 15° C. | $kg/m^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40° C. | $mm^2/sec$ | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1, 4) | µm | — | 400 | CEC F-06-A-96 |
| Fatty Acid Methyl Ester | | prohibited | | |

Example 3

The performance of fuel compositions of example 2 in modern diesel engines having a high pressure fuel system may be tested according to the CECF-98-08 DW 10 method. This is referred to herein as the DW10B test.

The engine of the injector fouling test is the PSA DW10BTED4. In summary, the engine characteristics are:

| | |
|---|---|
| Design: | Four cylinders in line, overhead camshaft, turbocharged with EGR |
| Capacity: | 1998 $cm^3$ |
| Combustion chamber: | Four valves, bowl in piston, wall guided direct injection |
| Power: | 100 kW @ 4000 rpm |
| Torque: | 320 Nm @ 2000 rpm |
| Injection system: | Common rail with piezo electronically controlled 6-hole injectors. |
| Max. pressure | 1600 bar ($1.6 \times 10^8$ Pa). Propriety design by SIEMENS VDO |
| Emissions control: | Conforms to Euro V limit values when combined with exhaust gas post-treatment system (DPF) |

This engine was chosen as a design representative of the modern European high-speed direct injection diesel engine capable of conforming to present and future European emissions requirements.

The common rail injection system uses a highly efficient nozzle design with rounded inlet edges and conical spray holes for optimal hydraulic flow. This type of nozzle, when combined with high fuel pressure has allowed advances to be achieved in combustion efficiency, reduced noise and reduced fuel consumption, but are sensitive to influences that can disturb the fuel flow, such as deposit formation in the spray holes. The presence of these deposits causes a significant loss of engine power and increased raw emissions.

The test is run with a future injector design representative of anticipated Euro V injector technology.

It is considered necessary to establish a reliable baseline of injector condition before beginning fouling tests, so a sixteen hour running-in schedule for the test injectors is specified, using non-fouling reference fuel.

Full details of the CEC F-98-08 test method can be obtained from the CEC. The coking cycle is summarised below.

1. A warm up cycle (12 minutes) according to the following regime:

| Step | Duration (minutes) | Engine Speed (rpm) | Torque (Nm) |
|---|---|---|---|
| 1 | 2 | idle | <5 |
| 2 | 3 | 2000 | 50 |
| 3 | 4 | 3500 | 75 |
| 4 | 3 | 4000 | 100 |

2. 8 hrs of engine operation consisting of 8 repeats of the following cycle

| Step | Duration (minutes) | Engine Speed (rpm) | Load (%) | Torque (Nm) | Boost Air After IC (° C.) |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 20 | 43 |
| 8 | 7 | 3000 | 100 | * | 50 |
| 9 | 2 | 1250 | (10) | 20 | 43 |
| 10 | 10 | 2000 | 100 | * | 50 |
| 11 | 2 | 1250 | (10) | 20 | 43 |
| 12 | 7 | 4000 | 100 | * | 50 |

* for expected range see CEC method CEC-F-98-08

3. Cool down to idle in 60 seconds and idle for 10 seconds 4. 4 hrs soak period

The standard CEC F-98-08 test method consists of 32 hours engine operation corresponding to 4 repeats of steps 1-3 above, and 3 repeats of step 4. ie 56 hours total test time excluding warm ups and cool downs.

Example 4

The ability of additives of the invention to remove 'Internal Diesel Injector Deposits' (IDIDs) may be measured according to he test method CEC F-110-16, available from the Co-ordinating European Council. The test uses the PSA DW10C engine.

The engine characteristics are shown in FIG. 1.

The test fuel (RF06) is dosed with 0.5 mg/kg Na in the form of Sodium Naphthenate+10 mg/kg Dodecyl Succinic Acid (DDSA).

The test procedure consists of main run cycles followed by soak periods, before cold starts are carried out.

The main running cycle consist of two speed and load set points, repeated for 6 hrs, as seen in FIGS. 2 and 3.

During the main run, parameters including, Throttle pedal position, ECU fault codes, Injector balance coefficient and Engine stalls are observed and recorded.

The engine is then left to soak at ambient temperature for 8 hrs.

After the soak period the engine is re-started. The starter is operated for 5 seconds; if the engine fails to start the engine is left for 60 seconds before a further attempt. A maximum of 5 attempts are allowed.

If the engine starts the engine is allowed to idle for 5 minutes. Individual exhaust temperatures are monitored and the maximum Temperature Delta is recorded. An increased variation in Cylinder-to-Cylinder exhaust temperatures is a good indication that injectors are suffering from IDID. Causing them to either open slowly or stay open to long.

An example in FIG. 4 of all exhaust temperatures with <30□C deviation, indicating no sticking caused by IDID.

The complete test comprises of 6× Cold Starts, although the Zero hour Cold Start does not form part of the Merit Rating and 5×6 hr Main run cycles, giving a total of 30 hrs engine running time.

The recorded data is inputted into the Merit Rating Chart. This allows a Rating to be produced for the test. Maximum rating of 10 shows no issues with the running or operability of the engine for the duration of the test.

An example is shown in FIG. 5.

Example 5

The effectiveness of the additives of the invention in older traditional diesel engine types was assessed using a standard industry test—CEC test method No. CEC F-23-A-01.

This test measures injector nozzle coking using a Peugeot XUD9 A/L Engine and provides a means of discriminating between fuels of different injector nozzle coking propensity. Nozzle coking is the result of carbon deposits forming between the injector needle and the needle seat. Deposition of the carbon deposit is due to exposure of the injector needle and seat to combustion gases, potentially causing undesirable variations in engine performance.

The Peugeot XUD9 A/L engine is a 4 cylinder indirect injection Diesel engine of 1.9 litre swept volume, obtained from Peugeot Citroen Motors specifically for the CEC PF023 method.

The test engine is fitted with cleaned injectors utilising unflatted injector needles. The airflow at various needle lift positions have been measured on a flow rig prior to test. The engine is operated for a period of 10 hours under cyclic conditions.

| Stage | Time (secs) | Speed (rpm) | Torque (Nm) |
|---|---|---|---|
| 1 | 30 | 1200 ± 30 | 10 ± 2 |
| 2 | 60 | 3000 ± 30 | 50 ± 2 |
| 3 | 60 | 1300 ± 30 | 35 ± 2 |
| 4 | 120 | 1850 ± 30 | 50 ± 2 |

The propensity of the fuel to promote deposit formation on the fuel injectors is determined by measuring the injector nozzle airflow again at the end of test, and comparing these values to those before test. The results are expressed in terms of percentage airflow reduction at various needle lift positions for all nozzles. The average value of the airflow reduction at 0.1 mm needle lift of all four nozzles is deemed the level of injector coking for a given fuel.

Example 6

A diesel fuel composition comprising additive A15 (105 ppm active) was tested according to the XUD9 test described in example 5 and its performance compared with that of base fuel.

The results are shown in table 4:

| | | % Flow loss | | | | |
|---|---|---|---|---|---|---|
| Base Fuel | Additive | Nozzle 1 | Nozzle 2 | Nozzle 3 | Nozzle 4 | Average |
| RF-06-03 | n/a | 68 | 81 | 79 | 64 | 73 |
| RF-06-03 | A15 @ 105 mg/kg | 3 | 3 | 43 | 3 | 13 |

The invention claimed is:

1. A composition comprising a diesel fuel and a quaternary ammonium salt additive of formula (I):

(I)

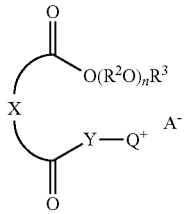

wherein X is a linking group; Y is O, NH or $NR^1$ wherein $R^1$ is H or an optionally substituted hydrocarbyl group; $Q^+$ is a moiety that includes a quaternary ammonium cation; $A^-$ is an anion; $R^2$ is an optionally substituted alkylene group; $R^3$ is hydrogen or an optionally substituted hydrocarbyl group; and n is 0 or a positive integer; provided that n is not 0 when $R^3$ is hydrogen.

2. A method of improving the performance of an engine, the method comprising combusting in the engine a diesel fuel composition comprising as an additive a quaternary ammonium salt of formula (I):

(I)

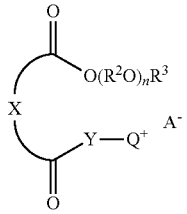

wherein X is a linking group; Y is O, NH or $NR^1$ wherein $R^1$ is H or an optionally substituted hydrocarbyl group; $Q^+$ is a moiety that includes a quaternary ammonium cation; $A^-$ is an anion; $R^2$ is an optionally substituted alkylene group; $R^3$ is hydrogen or an optionally substituted hydrocarbyl group; and n is 0 or a positive integer; provided n is not 0 when $R^3$ is hydrogen.

3. The composition according to claim 1 wherein the quaternary ammonium salt additive is prepared by reacting:

(a) a hydrocarbyl substituted dicarboxylic acid or anhydride thereof; with (b) an alcohol of formula $R^3(OR^2)_nOH$;

(c) a reactive alcohol or amine including a tertiary amino group; and (d) a quaternising agent.

4. The composition according to claim 1 wherein X is an optionally substituted alkylene or arylene.

5. The composition according to claim 1 wherein n is 0 and $R^3$ is an optionally substituted alkyl or alkenyl group having 4 to 40 carbon atoms.

6. The composition according to claim 1 wherein each $R^2$ is ethylene or propylene.

7. The composition according to claim 1 wherein $R^3$ is hydrogen and n is at least 1.

8. The composition according to claim 1 wherein $R^3$ is an optionally substituted alkyl group having 4 to 40 carbon atoms and n is from 1 to 40.

9. The composition according to claim 1 wherein $Q^+$ is a group having the formula:

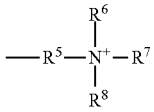

wherein $R^5$ is an optionally substituted alkylene, arylene or alkenylene group and each of $R^6$, $R^7$ and $R^8$ is independently an optionally substituted hydrocarbyl group.

10. The composition according to claim 9 wherein $R^5$ is an optionally substituted alkylene group having 1 to 6 carbon atoms, $R^6$ is $C_1$ to $C_6$ alkyl, $R^7$ is $C_1$ to $C_6$ alkyl and $R^8$ is an unsubstituted $C_1$ to $C_6$ alkyl group or a hydroxy substituted $C_1$ to $C_{40}$ alkyl group.

11. The composition according to claim 1 wherein $A^-$ is a carboxylate anion.

12. The composition according to claim 1 wherein the quaternary ammonium salt additive is prepared by reacting:

(a) an optionally substituted succinic acid or anhydride thereof;

(b) an alcohol of formula $H(OR^2)_nOH$ or $R^3OH$;

(c) a reactive alcohol including a tertiary amino group; and (d) a quaternising agent.

13. The composition according to claim 1 wherein the quaternary ammonium salt additive is prepared by reacting:

(a) a succinic acid or anhydride thereof substituted with a $C_{20}$ to $C_{24}$ alkyl or alkenyl group;

(b) a polypropylene glycol or butanol;

(c) dimethylaminopropanol; and (d) a quaternising agent selected from the group consisting of: methyl salicylate, dimethyl oxalate and a hydrocarbyl epoxide in combination with an acid.

14. The composition according to claim 1 wherein the diesel fuel composition further comprises one or more detergents selected from the group consisting of:

a quaternary ammonium salt additive;

(ii) the product of a Mannich reaction between an aldehyde, an amine and an optionally substituted phenol;

(iii) the reaction product of a carboxylic acid-derived acylating agent and an amine;

(iv) the reaction product of a carboxylic acid-derived acylating agent and hydrazine;

(v) a salt formed by the reaction of a carboxylic acid with di-n-butylamine or tri-n-butylamine;

(vi) the reaction product of a hydrocarbyl-substituted dicarboxylic acid or anhydride and an amine compound or salt which product comprises at least one amino triazole group; and (vii) a substituted polyaromatic detergent additive.

15. The composition according to claim 1 wherein the diesel fuel composition comprises a mixture of two or more quarternary ammonium salt additives.

16. The method according to claim 2 wherein the engine is a modern diesel engine having a high pressure fuel system.

17. The method according to claim 2 which achieves "keep clean" performance.

18. The method according to claim 2 which achieves "clean up" performance.

19. The method according to claim 2 which prevents or reduces the occurrence of deposits in the diesel engine, wherein the deposits are injector deposits.

20. The method according to claim 19 wherein the deposits are internal diesel injector deposits.

21. The method according to claim 2 which achieves an improvement in performance of one or more of:

a reduction in power loss of the engine;

a reduction in external diesel injector deposits;

a reduction in internal diesel injector deposits;

an improvement in fuel economy;

a reduction in fuel filter deposits;

a reduction in emissions; and an increase in maintenance intervals.

22. The method according to claim 21 which provides an improvement in performance in modern diesel engines having a high pressure fuel system and provides an improvement in performance in traditional diesel engines.

23. The composition according to claim 1 which further comprises one or more further additives selected from the group consisting of: lubricity improvers, corrosion inhibitors and cold flow improvers.

* * * * *